US008633872B2

(12) United States Patent
Osame

(10) Patent No.: US 8,633,872 B2
(45) Date of Patent: Jan. 21, 2014

(54) SEMICONDUCTOR DEVICE, AND DISPLAY DEVICE AND ELECTRONIC EQUIPMENT EACH HAVING THE SAME

(75) Inventor: Mitsuaki Osame, Kanagawa (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 1897 days.

(21) Appl. No.: 11/539,993

(22) Filed: Oct. 10, 2006

(65) Prior Publication Data

US 2007/0152921 A1 Jul. 5, 2007

(30) Foreign Application Priority Data

Oct. 18, 2005 (JP) ..... 2005-303756

(51) Int. Cl.
*G09G 3/30* (2006.01)

(52) U.S. Cl.
USPC ..... 345/76; 345/77

(58) Field of Classification Search
USPC ..... 345/76–83; 315/169.3
See application file for complete search history.

(56) References Cited

U.S. PATENT DOCUMENTS 6,246,180 B1 6/2001 Nishigaki
6,525,704 B1 2/2003 Kondo et al.
6,583,775 B1 6/2003 Sekiya et al.
6,791,129 B2 * 9/2004 Inukai ..... 257/208
6,909,240 B2 6/2005 Osame et al.
6,958,750 B2 * 10/2005 Azami et al. ..... 345/204
7,112,927 B2 9/2006 Osame et al.
7,233,323 B2 6/2007 Watsuda
7,355,571 B2 4/2008 Yamada
7,358,942 B2 4/2008 Yamazaki et al.
7,453,427 B2 * 11/2008 Kimura ..... 345/78
7,755,581 B2 7/2010 Osame et al.
7,791,568 B2 9/2010 Yamada (Continued)

FOREIGN PATENT DOCUMENTS

JP 2000-221942 8/2000
JP 2000221942 A 8/2000

(Continued)

OTHER PUBLICATIONS

European Search Report (Application No. 06020954.1), dated Feb. 9, 2007.

(Continued)

*Primary Examiner* — Alexander Eisen
*Assistant Examiner* — Nelson Lam
(74) *Attorney, Agent, or Firm* — Fish & Richardson P.C.

(57) ABSTRACT

Amplitude of a data line is made small, thereby reducing power consumption. Included are a first transistor to which a first scan signal is supplied through a first scan line; a second transistor to which a second scan signal is supplied through a second scan line; a third transistor which is turned on or off depending on a first signal supplied from a current supply line through the first transistor and a second signal supplied from a data line through the second transistor; a pixel electrode; and a light-emitting element which emits light by driving current flowing between the pixel electrode and a counter electrode. The first signal cuts electrical connection between the current supply line and the pixel electrode through the third transistor, and the second signal makes the current supply line and the pixel electrode electrically connected through the third transistor.

17 Claims, 24 Drawing Sheets

(56) References Cited

U.S. PATENT DOCUMENTS

| | | | | |
|---|---|---|---|---|
| 7,796,099 | B2 | 9/2010 | Osame et al. | |
| 7,928,938 | B2 | 4/2011 | Osame et al. | |
| 8,248,330 | B2 | 8/2012 | Osame | |
| 2002/0024493 | A1 | 2/2002 | Ozawa et al. | |
| 2003/0058207 | A1 | 3/2003 | Washio et al. | |
| 2003/0066740 | A1 | 4/2003 | Inukai | |
| 2003/0209989 | A1* | 11/2003 | Anzai et al. | 315/169.3 |
| 2003/0214245 | A1* | 11/2003 | Yamazaki et al. | 315/169.3 |
| 2004/0189615 | A1 | 9/2004 | Osame et al. | |
| 2004/0233141 | A1* | 11/2004 | Matsumoto | 345/76 |
| 2004/0251465 | A1 | 12/2004 | Yamazaki et al. | |
| 2004/0251953 | A1 | 12/2004 | Yamazaki et al. | |
| 2004/0256617 | A1* | 12/2004 | Yamada et al. | 257/59 |
| 2005/0030265 | A1* | 2/2005 | Miyagawa | 345/76 |
| 2005/0093791 | A1* | 5/2005 | Lo | 345/82 |
| 2005/0225250 | A1 | 10/2005 | Anzai et al. | |
| 2005/0231122 | A1 | 10/2005 | Osame et al. | |
| 2005/0243036 | A1* | 11/2005 | Ikeda | 345/76 |
| 2006/0044229 | A1* | 3/2006 | Yamazaki et al. | 345/76 |
| 2006/0066536 | A1* | 3/2006 | Ota et al. | 345/76 |
| 2006/0076567 | A1 | 4/2006 | Miyagawa et al. | |
| 2006/0139279 | A1 | 6/2006 | Yamazaki et al. | |
| 2008/0169765 | A1 | 7/2008 | Yamazaki et al. | |
| 2010/0289840 | A1 | 11/2010 | Osame et al. | |
| 2011/0187762 | A1 | 8/2011 | Osame et al. | |

FOREIGN PATENT DOCUMENTS

| | | | |
|---|---|---|---|
| JP | 2000-347621 | | 12/2000 |
| JP | 2000347621 | A | 12/2000 |
| JP | 2001-042822 | | 2/2001 |
| JP | 2001042822 | A | 2/2001 |
| JP | 2001-060076 | | 3/2001 |
| JP | 2004004910 | A | 1/2004 |
| JP | 2004-118184 | A | 4/2004 |
| JP | 2005-037415 | A | 2/2005 |
| JP | 2006-323370 | A | 11/2006 |
| JP | 2006-323371 | A | 11/2006 |
| KR | 2005-0057173 | A | 6/2005 |
| TW | 552568 | B | 9/2003 |
| TW | 200402671 | A | 2/2004 |
| WO | 03/030136 | A2 | 4/2003 |
| WO | 03/105117 | A2 | 12/2003 |
| WO | 2004/023445 | A1 | 3/2004 |
| WO | 2006/112421 | A1 | 10/2006 |

OTHER PUBLICATIONS

Korean Office Action (KR Application No. 2006-0099802) dated Mar. 27, 2013 with English translation.

Taiwanese Office Action (TW Application No. 095137738) dated Aug. 9, 2013, with English translation, 18 pages.

* cited by examiner

FIG. 3A reset period
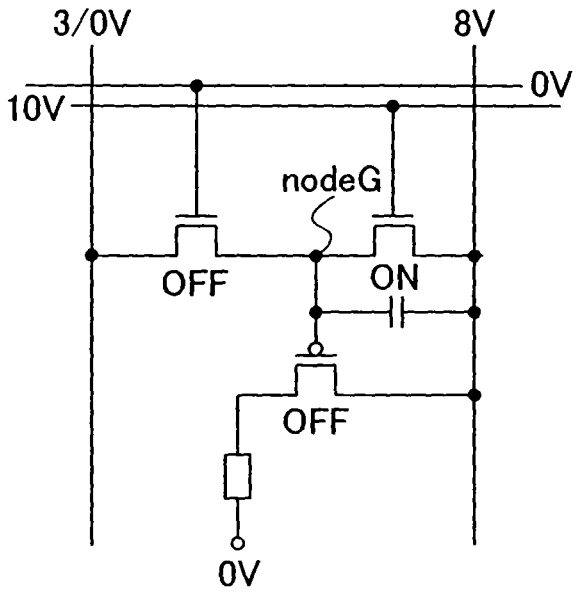
FIG. 3B blank period
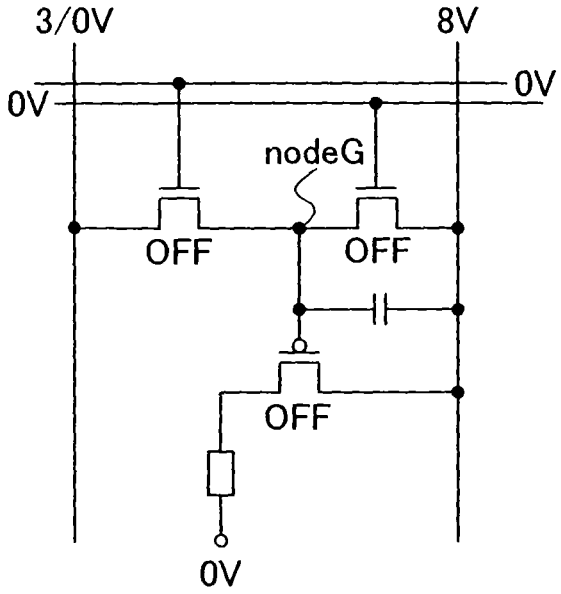

FIG. 4A sustain period (light emitting signal input period)
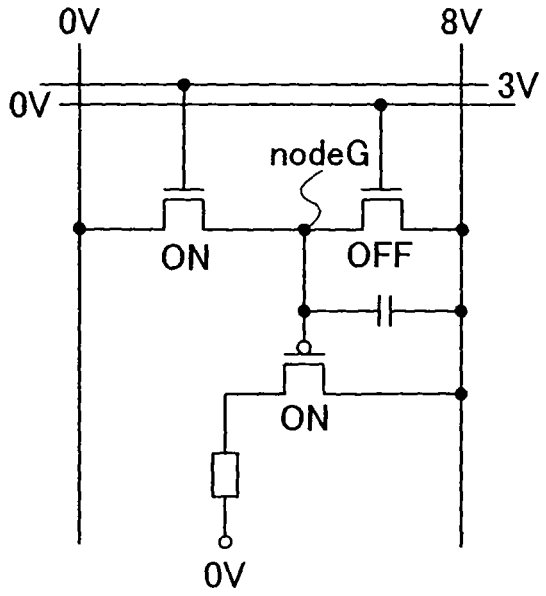
FIG. 4B sustain period (non-light emitting signal input period)
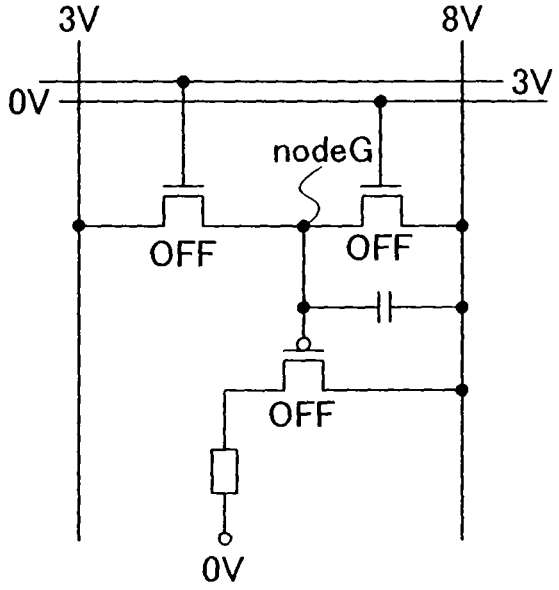

FIG. 9A reset period
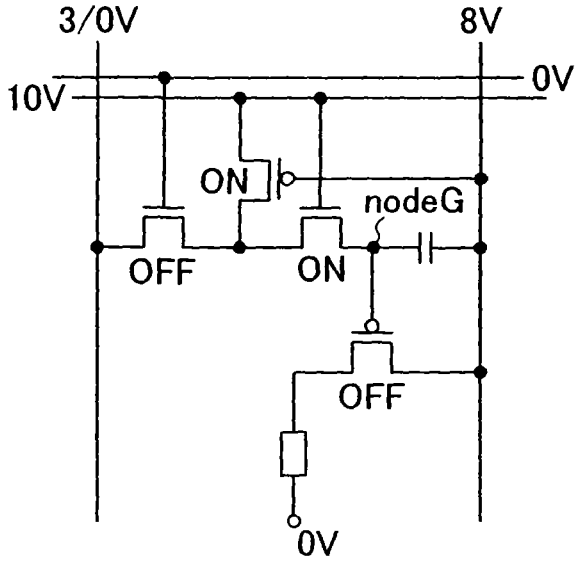
FIG. 9B blank period
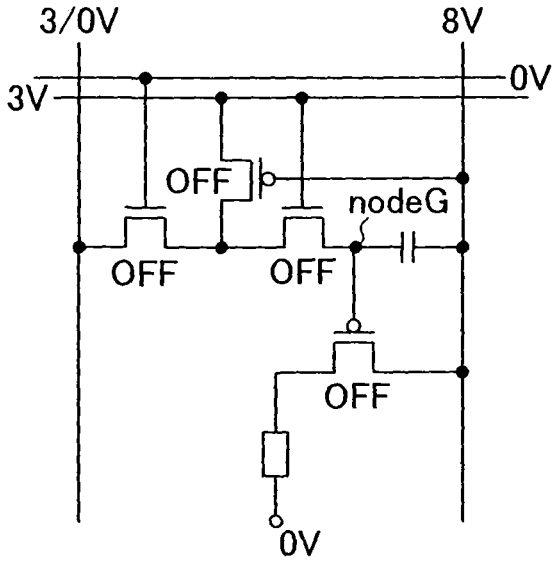

sustain period
(light emitting signal input period)

sustain period
(light emitting signal holding period)

sustain period
(non-light emitting signal input period)

sustain period
(non-light emitting signal holding period)

FIG. 13A reset period
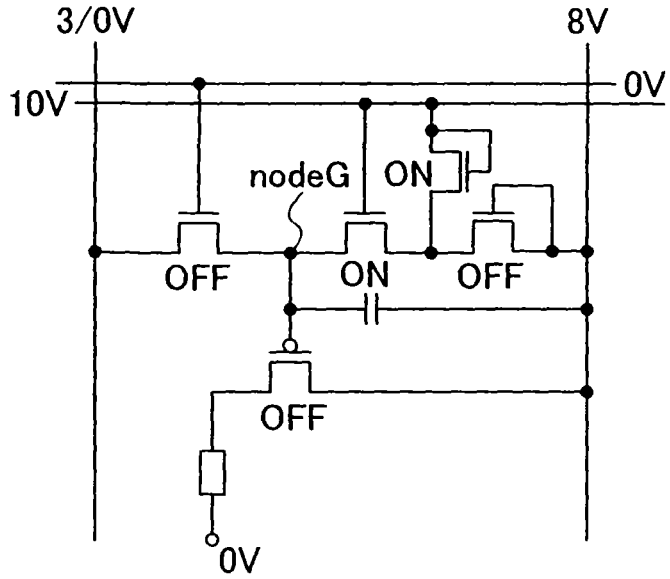
FIG. 13B blank period
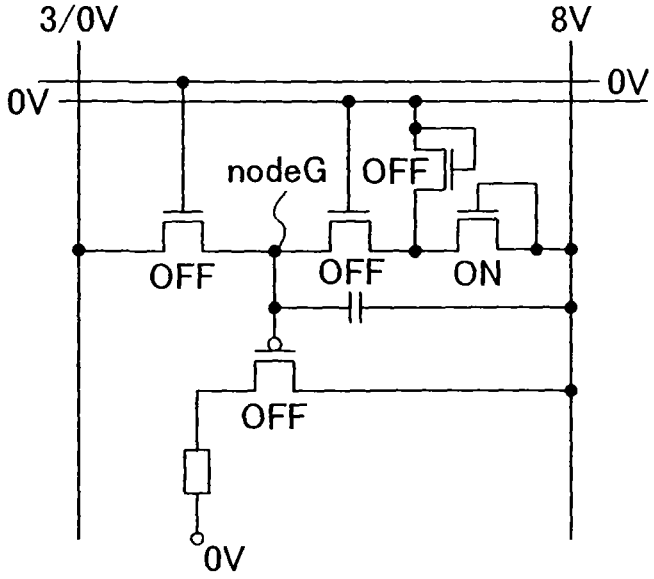

FIG. 14A sustain period (light emitting signal input period)
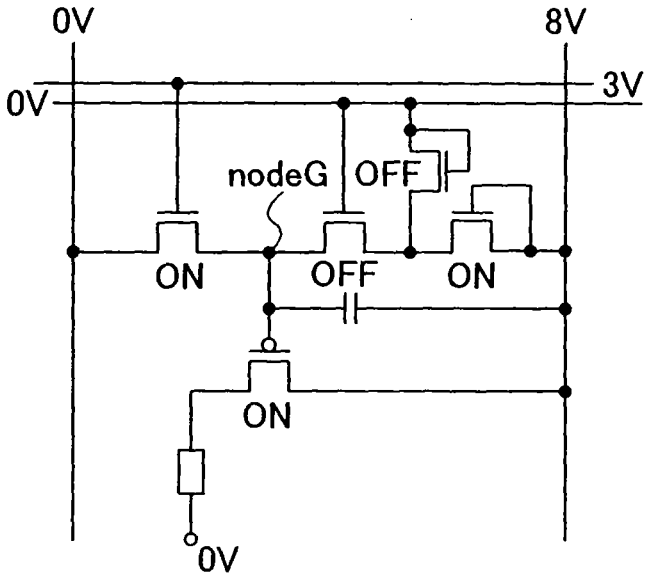
FIG. 14B sustain period (non-light emitting signal input period)
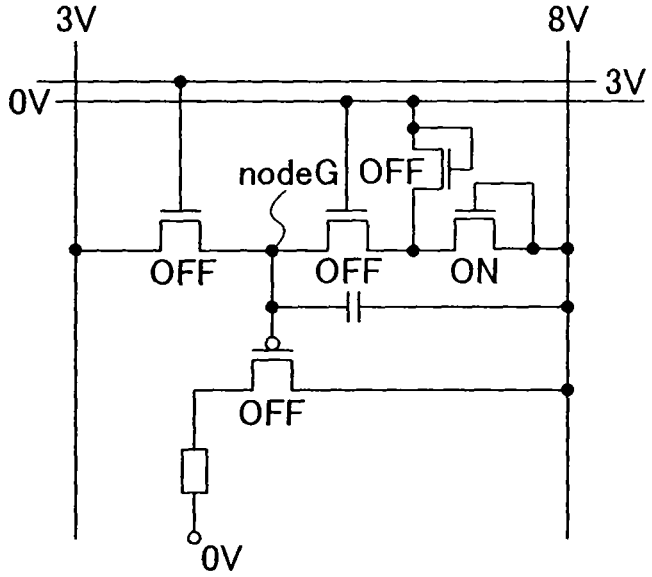

SEMICONDUCTOR DEVICE, AND DISPLAY DEVICE AND ELECTRONIC EQUIPMENT EACH HAVING THE SAME

BACKGROUND OF THE INVENTION

1. Field of the Invention

The present invention relates to a semiconductor device. In particular, the present invention relates to a structure of a pixel in an active matrix display which includes a light-emitting element and is manufactured using a semiconductor device. Moreover, the present invention relates to a display device equipped with a semiconductor device, and electronic equipment equipped with the display device.

A semiconductor device herein described indicates any device which can function by using a semiconductor characteristic.

2. Description of the Related Art

In recent years, demand for thin displays mainly applied to TVs, PC monitors, mobile terminals, and the like has increased rapidly and further development has been promoted. The thin displays include a liquid crystal display device (LCD) and a display device equipped with a light-emitting element. In particular, an active matrix display using a light-emitting element is expected as a next-generation display because of its features of high response speed, wide viewing angle, and the like in addition to advantages of a conventional LCD such as thinness, lightness in weight, and high image quality.

In an active matrix display using a light-emitting element, the most basic pixel structure is a structure shown in FIG. 24A (e.g., see FIGS. 19, 20A and 20B in Japanese Published Patent Application No. 2004-004910). In FIG. 24A, the pixel includes a driving transistor 2402 for controlling current supply to a light-emitting element 2404, a switching transistor 2401 for taking a potential of a data line 2406 into a gate (hereinafter also called a "node G") of the driving transistor 2402 by a scan line 2405, and a holding capacitor 2403 for holding the potential of the node G In FIG. 24A, the active matrix display including the light-emitting element 2404 can be driven by either an analog driving method or a digital driving method. In the analog driving method, an analog value is supplied to the gate of the driving transistor 2402 and the analog value is changed continuously, thereby expressing grayscale. In the digital driving method, a digital value is supplied to the gate of the driving transistor 2402: in the digital driving method, there is a digital time grayscale method in which one frame period is divided into a plurality of subframes and a light-emission period is controlled, thereby expressing grayscale. The digital driving method is advantageous in that it is hard to be affected by variation in transistors as compared to the analog driving method.

A specific example of a potential relation and operation timing when driving the pixel in FIG. 24A is shown in FIG. 24B, and the operation is described. At this time, the light-emitting element 2404 is driven by the digital driving method. As shown in FIG. 24B, the potential of the data line 2406 is taken into the node G when the potential of the scan line 2405 is a potential (a High potential, here) at which the driving transistor 2402 is turned on in the pixel structure shown in FIG. 24A.

In FIG. 24A, since the switching transistor 2401 is an N-channel transistor and the driving transistor 2402 is a P-channel transistor, the switching transistor 2401 is turned on and the potential of the data line 2406 is taken into the node G when the potential of the scan line 2405 is High. Respective potentials are set such that the light-emitting element 2404 emits light by taking a Low potential of the data line 2406 whereas does not emit light by taking a High potential of the data line 2406 into the node G.

As a specific example of the respective potentials, in FIG. 24A, the potential of a counter electrode of the light-emitting element 2404 is set to be GND (hereinafter 0 V), the potential of a current supply line 2407 is set to be 7 V, a High potential of the data line 2406 is set to be 7 V and a Low potential thereof is set to be 0 V, and a High potential of the scan line 2405 is set to be 10 V and a Low potential thereof is set to be 0 V.

Potential change of the wires is described using FIG. 24C. In a period during which the scan line 2405 has a potential of 10 V, the switching transistor 2401 is turned on and the potential of the data line 2406 is taken into the node G. By taking a potential of 0 V into the node G, a Vgs (a gate-source voltage) of 7 V is applied to the driving transistor 2402, thereby the driving transistor 2402 operates in the linear region enough. At this time, a voltage of about 7 V is applied to the light-emitting element 2404, and a current flows depending on resistance of the light-emitting element 2404 so that light emission is performed. On the other hand, by taking a potential of 7 V into the node G, the driving transistor 2402 is turned off because the Vgs thereof becomes 0 V, thereby the light-emitting element 2404 does not emit light. The potential of the node G is held by the holding capacitor 2403 until the potential of the scan line 2405 becomes High again.

In the example described using FIG. 24A, the potential of the node G is either the High potential or the Low potential of the data line 2406. The High potential of the data line 2406 is generally set to be the same as or higher than the potential of the current supply line 2407; therefore, when the voltage to be applied to the light-emitting element 2404, that is, the potential of the current supply line 2407 is increased, the voltage of the data line 2406 is also required to be increased.

In the digital driving method, selection pulses are outputted from a scan line driver circuit sequentially to rows of the scan line 2405, and data signals are outputted from a data line driver circuit at the same time to columns of the data line 2406 in accordance with the selection pulses.

Power consumption of a buffer portion in the data line driver circuit for charging/discharging the data line 2406 is dominant in power consumption of the driver circuits of the digital-driving display device. Power consumption P is generally calculated from the following formula (1), where F is frequency, C is capacitance, and V is voltage;

$$P=FCV^2 \text{ (F: frequency, C: capacitance, V: voltage)} \quad (1)$$

It is therefore found from the formula (1) that decreasing the voltage of the data line 2406 to be set is effective to reduce the power consumption.

SUMMARY OF THE INVENTION

In view of the foregoing, the present invention provides a pixel structure and its driving method, in which the voltage of the data line can be made small to reduce power consumption, relating to control between light emission and non-light emission of a light-emitting element.

According to a semiconductor device of the present invention, the following are included: a first transistor to which a first scan signal is applied to a gate thereof through a first scan line; a second transistor to which a second scan signal is applied to a gate thereof through a second scan line; a third transistor which is turned on or off depending on a first signal and a second signal applied to a gate thereof; a pixel electrode; and a light-emitting element which emits light by a driving current which flows between the pixel electrode and a counter electrode. The first signal supplied through the first transistor from a current supply line is a signal which cuts an electrical connection between the current supply line and the pixel electrode through the third transistor, and the second signal supplied through the second transistor from a data line is a signal which makes the current supply line and the pixel electrode electrically connected to each other through the third transistor.

According to another semiconductor device of the present invention, the following are included: a first transistor to which a first scan signal is applied to a gate thereof through a first scan line; a second transistor to which a second scan signal is applied to a gate thereof through a second scan line; a third transistor which is turned on or off depending on a first signal and a second signal applied to a gate thereof; a pixel electrode; and a light-emitting element which emits light by a driving current which flows between the pixel electrode and a counter electrode. The first signal supplied through the first transistor from a power supply line is a signal which cuts an electrical connection between a current supply line and the pixel electrode through the third transistor, and the second signal supplied through the second transistor from a data line is a signal which makes the current supply line and the pixel electrode electrically connected to each other through the third transistor.

In addition, the potential of the power supply line and the potential of the current supply line may be different.

In addition, the first transistor and the second transistor may be N-channel transistors and the third transistor may be a P-channel transistor.

According to another semiconductor device of the present invention, the following are included: a first transistor to which a first scan signal is applied to a gate thereof through a first scan line; a second transistor to which a second scan signal is applied to a gate thereof through a second scan line; a third transistor which is turned on or off depending on the potential of a current supply line; a fourth transistor which is turned on or off depending on a first signal and a second signal applied to a gate thereof; a pixel electrode; and a light-emitting element which emits light by a driving current which flows between the pixel electrode and a counter electrode. The first signal supplied through the first transistor and the third transistor from the first scan line is a signal which cuts an electrical connection between the current supply line and the pixel electrode through the fourth transistor, and the second signal supplied through the second transistor from a data line is a signal which makes the current supply line and the pixel electrode electrically connected to each other through the fourth transistor.

In addition, the first transistor, the second transistor, and the third transistor may be N-channel transistors and the fourth transistor may be a P-channel transistor.

According to another semiconductor device of the present invention, the following are included: a first transistor to which a first scan signal is applied to a gate thereof through a first scan line; a second transistor to which a second scan signal is applied to a gate thereof through a second scan line; a third transistor which is turned on or off depending on the potential of a current supply line; a fourth transistor which is turned on or off depending on the first scan signal; a fifth transistor which is turned on or off depending on a first signal and a second signal applied a gate thereof; a pixel electrode; and a light-emitting element which emits light by a driving current which flows between the pixel electrode and a counter electrode. The first signal supplied through the first transistor and the fourth transistor from the first scan line is a signal which cuts an electrical connection between the current supply line and the pixel electrode through the fifth transistor, and the second signal supplied through the second transistor from a data line is a signal which makes the current supply line and the pixel electrode electrically connected to each other through the fifth transistor.

In addition, the first transistor, the second transistor, the third transistor, and the fourth transistor may be N-channel transistors and the fifth transistor may be a P-channel transistor.

In addition, the amplitude of the first scan signal may be larger than that of the second scan signal.

According to a driving method of a semiconductor device of the present invention, the following are included: a first transistor to which a first scan signal is applied to a gate thereof through a first scan line; a second transistor to which a second scan signal is applied to a gate thereof through a second scan line; a third transistor which is turned on or off depending on the potential applied to a gate thereof; a pixel electrode; and a light-emitting element which emits light by a driving current which flows between the pixel electrode and a counter electrode. The following are provided: a first period during which the first transistor is turned on by the first scan signal, and a first signal for cutting an electrical connection between a current supply line and the pixel electrode through the third transistor is inputted to the gate of the third transistor through the first transistor from the current supply line; a second period during which the first transistor is turned off by the first scan signal, and the second transistor is turned off by the second scan signal; and a third period during which the second scan signal is inputted to the second transistor. In the third period, in the case where the potential of a data line is smaller than the potential of the second scan signal, a second signal for electrically connecting between the current supply line and the pixel electrode through the third transistor is inputted to the gate of the third transistor through the second transistor from the data line.

In addition, the first signal may be inputted through the first transistor from a wire having a potential different from that of the current supply line.

In addition, the first transistor and the second transistor may be N-channel transistors and the third transistor may be a P-channel transistor.

According to another driving method of a semiconductor device of the present invention, the following are included: a first transistor to which a first scan signal is applied to a gate thereof through a first scan line; a second transistor to which a second scan signal is applied to a gate thereof through a second scan line; a third transistor which is turned on or off depending on the potential of a current supply line; a fourth transistor which is turned on or off depending on a signal applied to a gate thereof; a pixel electrode; and a light-emitting element which emits light by a driving current which flows between the pixel electrode and a counter electrode. The following are provided: a first period during which the first transistor is turned on by the first scan signal, and a first signal for cutting an electrical connection between the current supply line and the pixel electrode through the fourth transistor is inputted to the gate of the fourth transistor through the first transistor and the third transistor from the first scan line; a second period during which the first transistor is turned off by the first scan signal, and the second transistor is turned off by the second scan signal; and a third period during which the second scan signal is inputted to the second transistor. In the third period, in the case where the potential of a data line is smaller than the potential of the second scan signal, a second signal for electrically connecting between the current supply line and the pixel electrode through the fourth transistor is inputted to the gate of the fourth transistor through the first transistor and the second transistor from the data line.

In addition, the first transistor, the second transistor, and the third transistor may be N-channel transistors and the fourth transistor may be a P-channel transistor.

According to another driving method of a semiconductor device of the present invention, the following are included: a first transistor to which a first scan signal is applied to a gate thereof through a first scan line; a second transistor to which a second scan signal is applied to a gate thereof through a second scan line; a third transistor which is turned on or off depending on the potential of a current supply line; a fourth transistor which is turned on or off depending on the first scan signal; a fifth transistor which is turned on or off depending on a signal applied to a gate thereof; a pixel electrode; and a light-emitting element which emits light by a driving current which flows between the pixel electrode and a counter electrode. The following are provided: a first period during which the first transistor and the fourth transistor are turned on by the first scan signal, and a first signal for cutting an electrical connection between the current supply line and the pixel electrode through the fifth transistor is inputted to the gate of the fifth transistor through the first transistor and the fourth transistor from the first scan line; a second period during which the first transistor is turned off by the first scan signal, and the second transistor is turned off by the second scan signal; and a third period during which the second scan signal is inputted to the second transistor. In the third period, in the case where the potential of a data line is smaller than the potential of the second scan signal, a second signal for electrically connecting between the current supply line and the pixel electrode through the fourth transistor is inputted to the gate of the fourth transistor through the first transistor from the data line.

In addition, the first transistor, the second transistor, the third transistor, and the fourth transistor may be N-channel transistors and the fifth transistor may be a P-channel transistor.

In addition, the amplitude of the first scan signal may be larger than that of the second scan signal.

By using the semiconductor device and the driving method of the present invention, a potential at which the driving transistor is turned on can be supplied from the data line, whereas a potential at which the driving transistor is turned off can be supplied from another wire such as the current supply line, both of the potentials are applied to the gate of the driving transistor. Accordingly, the semiconductor device and the driving method of the present invention can set the voltage of the data line to be lower, thereby power consumption can be drastically reduced.

BRIEF DESCRIPTION OF THE DRAWINGS

FIGS. 3A and 3B are diagrams each showing one mode of Embodiment Mode 1 of the present invention.

FIGS. 4A and 4B are diagrams each showing one mode of Embodiment Mode 1 of the present invention.

FIGS. 9A and 9B are diagrams each showing one mode of Embodiment Mode 3 of the present invention.

FIGS. 13A and 13B are diagrams each showing one mode of Embodiment Mode 4 of the present invention.

FIGS. 14A and 14B are diagrams each showing one mode of Embodiment Mode 4 of the present invention.

DETAILED DESCRIPTION OF THE INVENTION

Figure 1:
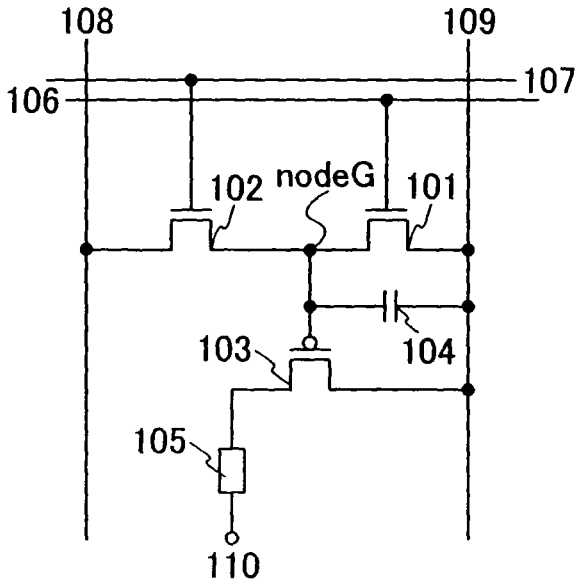
FIG. 1 is a circuit diagram of Embodiment Mode 1 of the present invention.

Although the invention will be fully described by way of embodiment modes and embodiments with reference to the accompanying drawings, it is to be understood that various changes and modifications will be apparent to those skilled in the art. Therefore, unless such changes and modifications depart from the scope of the invention, they should be construed as being included therein. Note that the same portions or the portions having similar functions are denoted by the same reference numerals in the following drawings, and description thereof is omitted.

Embodiment Mode 1

A first mode of the semiconductor device of the present invention is described. A specific pixel structure is shown in FIG. 1 and described in detail. Only one pixel is illustrated here, but actually a plurality of pixels is arranged in a matrix in row and column directions in a pixel portion of the semiconductor device.

The pixel structure of the present invention includes the following: a first transistor (also called a "reset transistor") 101 for taking the potential of a current supply line 109 into a node G in a period during which a first scan line 106 is selected by a first scan signal; a second transistor (also called a "selecting transistor") 102 for controlling whether the node G and a data line 108 are electrically connected to each other depending on the potential of the data line 108 and the potential of a second scan line 107 in a period during which the second scan line 107 is selected; a third transistor (also called a "driving transistor") 103 for controlling current supply from the current supply line 109 to a light-emitting element 105 depending on the potential of the node G; and a holding capacitor 104 for holding the potential of the node G. Note that for description, the first transistor 101 and the second transistor 102 are N-channel transistors and the third transistor 103 is a P-channel transistor in this embodiment mode. In addition, the light-emitting element 105 emits light by a current which flows in a direction from the current supply line 109 to a counter electrode 110. If the structure of the light-emitting element or the polarity of the transistor is changed, the connection of respective terminals of the transistors or respective signals to the wires may be arbitrary changed in the structure.

One of two electrodes of the holding capacitor 104 is connected to a gate of the third transistor 103 and the other thereof is connected to the current supply line 109. The holding capacitor 104 is provided in order to maintain the gate-source voltage (gate voltage) of the third transistor 103 more certainly; however, the holding capacitor is not necessarily provided when the potential of the node G can be held by parasitic capacitance of the third transistor 103 or the like. Further, the one electrode of the holding capacitor 104 is not necessarily connected to the current supply line 109 when the gate potential of the third transistor 103 can be held.

Description is made on the case where a thin film transistor (TFT) is used as a transistor in this specification. Amorphous silicon or crystalline silicon is used as a semiconductor for forming a channel forming region. Further, as the semiconductor for forming the channel forming region, a compound semiconductor, preferably an oxide semiconductor may be used as well. As the oxide semiconductor, for example, zinc oxide (ZnO), titanium oxide ($TiO_2$), magnesium zinc oxide ($Mg_xZn_{1-x}O$), cadmium zinc oxide ($Cd_xZn_{1-x}O$), cadmium oxide (CdO), an In—Ga—Zn—O amorphous oxide semiconductor (a-IGZO), or the like may be used.

In this specification, "connection" refers to an electrical connection unless specified. To the contrary, to "cut" refers to a state of being electrically disconnected by a switch such as a transistor.

One of a source or a drain of the first transistor 101 is connected to the current supply line 109, and the other of the source or the drain of the first transistor 101 is connected to the gate of the third transistor 103. A gate of the first transistor 101 is connected to the first scan line 106. One of a source or a drain of the second transistor 102 is connected to the data line 108, and the other of the source or the drain of the second transistor 102 is connected to the gate of the third transistor 103. A gate of the second transistor 102 is connected to the second scan line 107. One of a source or a drain of the third transistor 103 is connected to the current supply line 109, and the other of the source or the drain of the third transistor 103 is connected to a pixel electrode (not shown). One electrode of the light-emitting element 105 is connected to the pixel electrode and the other electrode thereof is connected to the counter electrode 110. One electrode of the holding capacitor 104 is connected to the gate of the third transistor 103 and the other electrode thereof is connected to the current supply line 109.

In this specification, the light-emitting element may have a structure interposed between the pixel electrode and the counter electrode.

In this embodiment mode, the one electrode of the light-emitting element is connected to the pixel electrode and the other electrode of the light-emitting element is connected to the counter electrode; however, such a structure in which the pixel electrode also functions as the one electrode of the light-emitting element and the counter electrode also functions as the other electrode of the light-emitting element may be used. In that case, the pixel electrode functions as an anode of the light-emitting element whereas the counter electrode functions as a cathode of the light-emitting element.

A potential Vss which is lower than the current supply line 109 is set at the counter electrode 110 of the light-emitting element 105. Note that Vss is, where a potential Vdd which is set at the current supply line 109 in a light-emitting period of the pixel is used as a criterion, a potential so as to satisfy Vss<Vdd; for example, Vss=GND (a ground potential).

Next, an operation method of the pixel structure shown in FIG. 1 is described using FIGS. 2A, 2B, 3A, 3B, 4A and 4B.

Figure 2A:
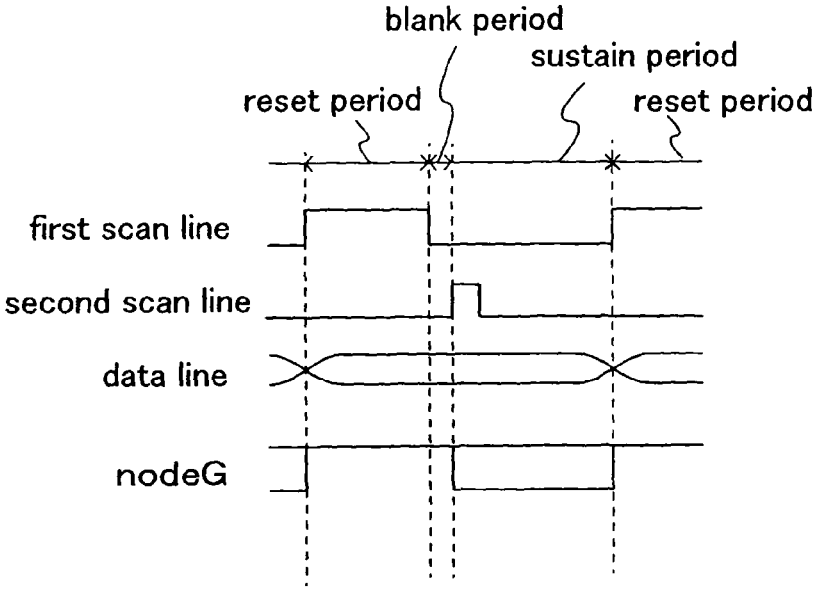
FIGS. 2A and 2B are timing charts of Embodiment Mode 1 of the present invention.
Figure 2B:
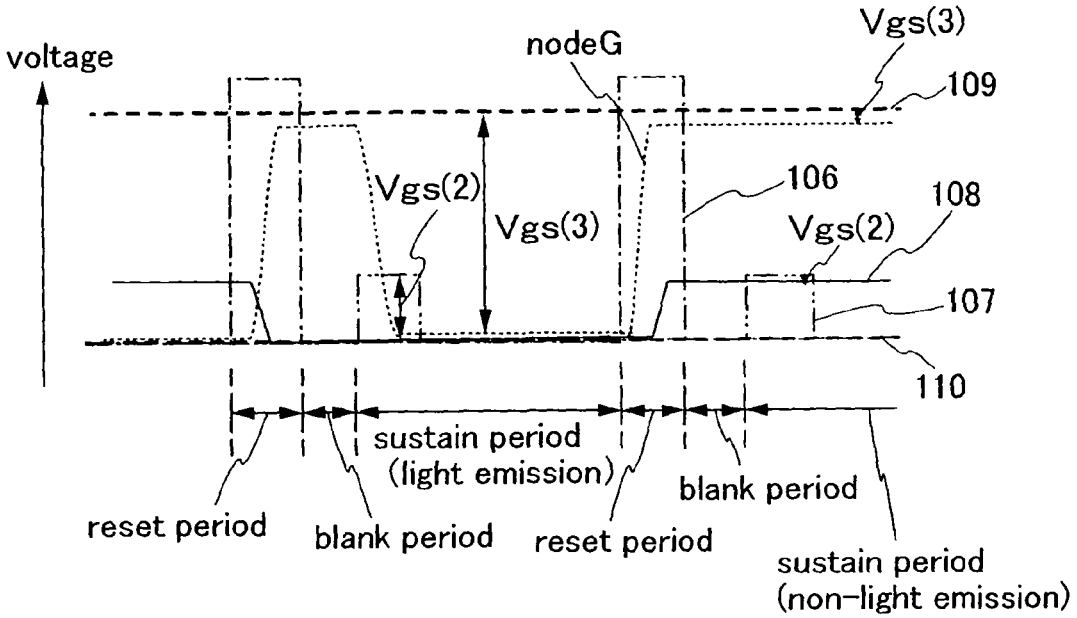

First, FIG. 2A shows a timing chart of the first scan line 106, the second scan line 107, the data line 108, and the node G in the pixel structure shown in FIG. 1 of the present invention. In the pixel structure of the present invention, a reset period, a blank period, and a sustain period (a period during which a light emitting state or a non-light emitting state starts by a data signal and is maintained by the holding capacitor until the next data signal is inputted) are provided.

In the pixel structure of the present invention, a potential for turning the driving transistor off is inputted in advance to the gate of the driving transistor, that is, the holding capacitor in the pixel. This period during which a signal for turning the driving transistor off is inputted in advance to the gate of the driving transistor in the pixel is referred to as the "reset period" in this specification.

In addition, in the pixel structure of the present invention, a signal for controlling whether the driving transistor is turned on or off is controlled by the first scan line and the second scan line. Therefore, in the pixel structure of the present invention, if the first scan line and the second scan line turn the first transistor and the second transistor on at the same time, conduction between the current supply line and the data line is permitted, which is not good. In view of this, by providing a blank period, a period during which none of the first transistor and the second transistor is turned on is provided in order to prevent conduction between the current supply line and the data line in the pixel structure of the present invention. In this embodiment mode, this period during which none of the first transistor and the second transistor is turned on by the first scan line and the second scan line is referred to as the "blank period". Of course this blank period is not necessarily provided when a switch or the like is additionally provided in order to prevent conduction between the current supply line and the data line in the pixel structure.

Using FIGS. 2A, 2B, 3A, 3B, 4A and 4B, potential change and timing of the portions, and on/off of each transistor in the reset period, the blank period, and the sustain period are described with specific examples. Where the voltage to be applied to the light-emitting element is 8 V, the potential of the current supply line 109 is 8 V, the potential of the counter electrode 110 is 0 V, the High potential of the first scan line 106 is 10 V, the Low potential thereof is 0 V, the High potential of the second scan line 107 is 3 V, the Low potential thereof is 0 V, the High potential of the data line 108 is 3 V, and the Low potential thereof is 0 V. Further, each threshold value of the first transistor 101 and the second transistor 102 is 1 V, and the third transistor 103 operates in the linear region enough.

First, in the reset period, the potential of the first scan line 106 is made High (10 V), the first transistor 101 is turned on, the node G has the potential of 8 V of the current supply line 109, the Vgs (gate-source voltage) of the third transistor 103 becomes 0 V, thereby the third transistor 103 is turned off (FIG. 3A).

Next, the blank period is provided, which prevents conduction between the current supply line 109 and the data line 108 caused by turning the first transistor 101 and the second transistor 102 on at the same time. In addition, before the second scan line 107 is made High (3 V), the potential of the data signal is required to be decided. The potential of the data line 108 is made Low (0 V) in the case where the light-emitting element is to emit light whereas is made High (3 V) in the case where the light-emitting element is not to emit light (FIG. 3B).

In the following sustain period, the second scan line 107 is made High (3 V), thereby the second transistor 102 is turned off because the Vgs (gate-source voltage) becomes 0 V in the case where the potential of the data line 108 is High (3 V), and the node G maintains 8 V (FIG. 4B). When the second scan line 107 is made High (3 V), the second transistor 102 is turned on because the Vgs becomes 3 V in the case where the potential of the data line 108 is Low (0 V), and the node G has 0 V which is the same potential as the data line 108 (FIG. 4A). Accordingly, whether the potential of the node G is High (8 V) or Low (0 V) is decided and is held for a certain period by the holding capacitor 104.

As described above in the pixel structure or the driving method of the semiconductor device of the present invention, to control between light emitting state and non-light emitting state of the light-emitting element depending on the data signal, the potential of the data line is the gate potential of the third transistor for driving in the light emitting state whereas the potential of the current supply line is the gate of the third transistor for driving in the non-light emitting state. Consequently, the voltage of the data line can be set to be lower, and power consumption can be drastically reduced.

This embodiment mode can be freely combined with the other embodiment modes and embodiments.

Embodiment Mode 2

Figure 5:
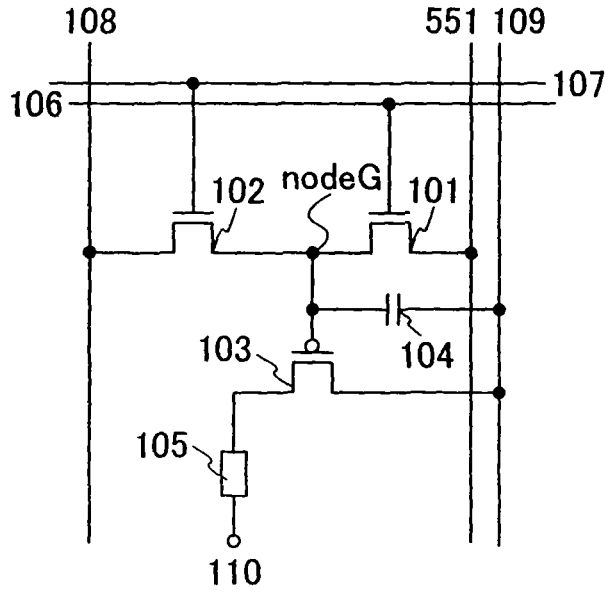
FIG. 5 is a circuit diagram of Embodiment Mode 2 of the present invention.

Another structure of the present invention, which is different from the pixel structure shown in FIG. 1 is described in this embodiment mode. A specific structure is shown in FIG. 5 and described. Only one pixel is illustrated here, but actually a plurality of pixels is arranged in a matrix in row and column directions in a pixel portion of the semiconductor device.

In Embodiment Mode 1, the gate of the driving transistor when the light-emitting element is not to emit light has a potential equal to the current supply line. In this embodiment mode, a power supply line which can supply a potential different from that of the current supply line is provided, so that the driving transistor can be turned off more certainly. According to this, a margin with respect to the variable factor such as off-leakage current of a transistor can be provided when a potential is held by the holding capacitor for a certain period.

The pixel structure of this embodiment mode includes the following as shown in FIG. 5: the first transistor (also called a "reset transistor") 101 for taking the potential of a power supply line 551 by the first scan line 106; the second transistor (also called a "selecting transistor") 102 for taking the potential of the data line 108 into the node G by the second scan line 107; the third transistor (also called a "driving transistor") 103 for controlling current supply from the current supply line 109 to the light-emitting element 105 depending on the potential of the node G; and the holding capacitor 104 for holding the potential of the node G. Note that for description, the first transistor 101 and the second transistor 102 are N-channel transistors and the third transistor 103 is a P-channel transistor in this embodiment mode. In addition, the light-emitting element 105 emits light by a current which flows in a direction from the current supply line 109 to the counter electrode 110. If the structure of the light-emitting element or the polarity of the transistor is changed, the connection of respective terminals of the transistors or respective signals may be arbitrary changed in the structure. As for the holding capacitor, the same described in Embodiment Mode 1 is applied.

One of a source or a drain of the first transistor 101 is connected to the power supply line 551, and the other of the source or the drain of the first transistor 101 is connected to a gate of the third transistor 103. A gate of the first transistor 101 is connected to the first scan line 106. One of a source or a drain of the second transistor 102 is connected to the data line 108, and the other of the source or the drain of the second transistor 102 is connected to the gate of the third transistor 103. A gate of the second transistor 102 is connected to the second scan line 107. One of a source or a drain of the third transistor 103 is connected to the current supply line 109, and the other of the source or the drain of the third transistor 103 is connected to the pixel electrode (not shown). One electrode of the light-emitting element 105 is connected to the pixel electrode and the other electrode thereof is connected to the counter electrode 110. One electrode of the holding capacitor 104 is connected to the gate of the third transistor 103 and the other electrode thereof is connected to the power supply line 551.

In this embodiment mode, the one electrode of the light-emitting element is connected to the pixel electrode and the other electrode of the light-emitting element is connected to the counter electrode; however, such a structure in which the pixel electrode also functions as the one electrode of the light-emitting element and the counter electrode also functions as the other electrode of the light-emitting element may be used.

Figure 6A:
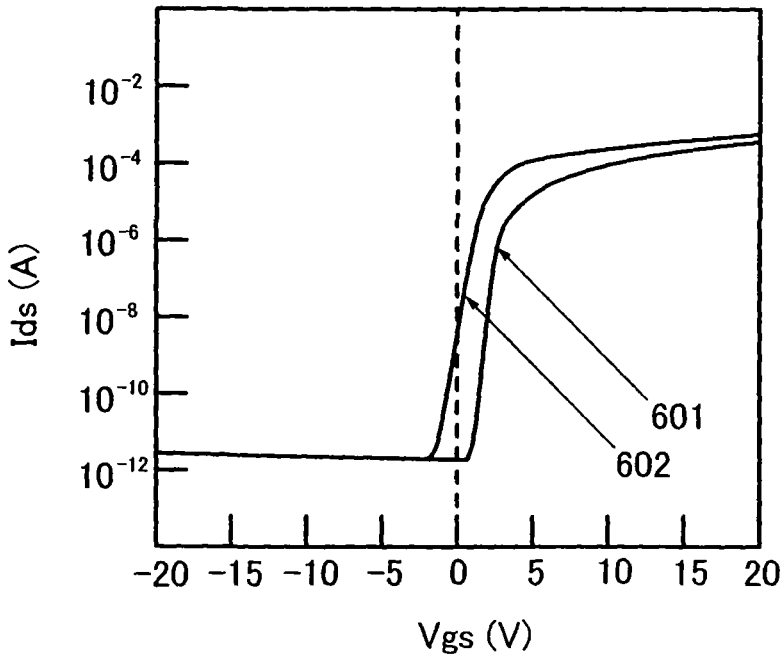
FIGS. 6A and 6B are diagrams for describing Embodiment Mode 2 of the present invention.
Figure 6B:
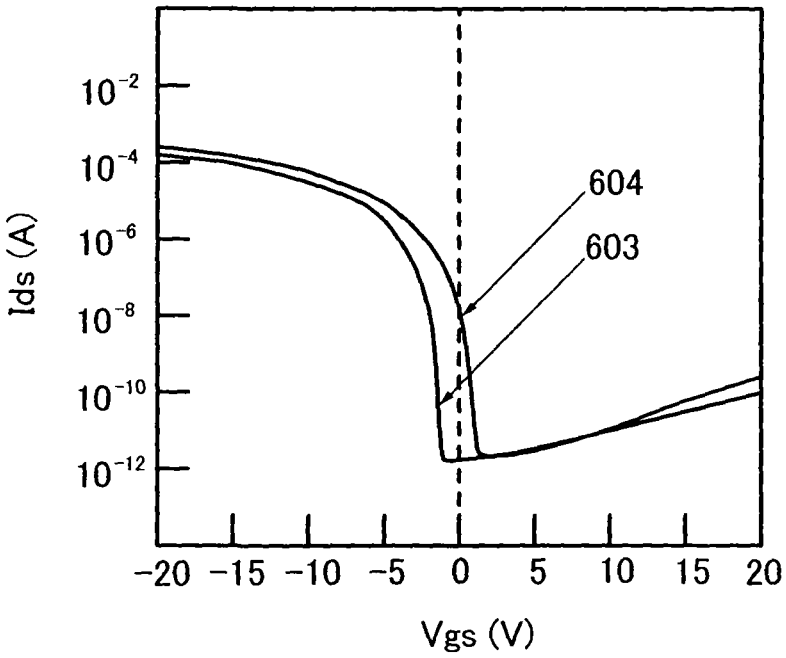

FIGS. 6A and 6B show examples of a curve of Vgs (gate-source voltage) vs. Ids (drain-source current) of the transistor. In FIGS. 6A and 6B, FIG. 6A shows the characteristics of an N-channel transistor whereas FIG. 6B shows the characteristics of a P-channel transistor. As a curve 601 shown in FIG. 6A and a curve 603 shown in FIG. 6B, in the case of an ideal transistor, a function as a transistor can be performed since Ids is sufficiently small at Vgs of 0 V. However, as a curve 602 shown in FIG. 6A and a curve 604 shown in FIG. 6B, current may flow even at Vgs of 0 V because of a shift of the characteristics of the transistor, which causes a trouble such as a defective operation or increase in power consumption. In particular, in a light-emitting element having a high luminous efficiency, light emission is recognized even in the case where the current is slight, which tends to be a display defect.

In this embodiment mode, the power supply line 551 is provided, and a potential Vdd2 of the power supply line 551 is set to be a potential to satisfy, comparing with a potential Vdd1 of the current supply line 109, Vdd1<Vdd2. For example, the potential of the current supply line 109 may be 8 V and the potential of the power supply line 551 may be 10 V. Accordingly, the gate of the driving transistor 103 in the case of a non-light emission state has a potential of 10 V so that the driving transistor 103 has a potential to turn off certainly.

Note that as for the pixel structure of FIG. 5 in this embodiment mode, the driving method, timing, and the like are similar to FIGS. 2A, 2B, 3A, 3B, 4A and 4B and the description thereof described in Embodiment Mode 1. In addition, although the power supply line 551 is arranged in parallel with the data line 108, the arrangement of the power supply line 551 is not particularly limited; for example, the power supply line 551 may be arranged in a direction vertical to the data line 108.

According to this embodiment mode, by setting different potentials at the current supply line and the power supply line, a signal which turns the driving transistor off certainly can be inputted to the gate thereof, and besides, a potential which turns the driving transistor on can be supplied from the data line whereas a potential which turns the driving transistor off can be supplied from another wire such as the current supply line, both of the potentials are applied to the gate of the driving transistor. Consequently, the voltage of the data line can be set to be lower, and power consumption can be drastically reduced.

This embodiment mode can be freely combined with the other embodiment modes and embodiments.

Embodiment Mode 3

Figure 7:
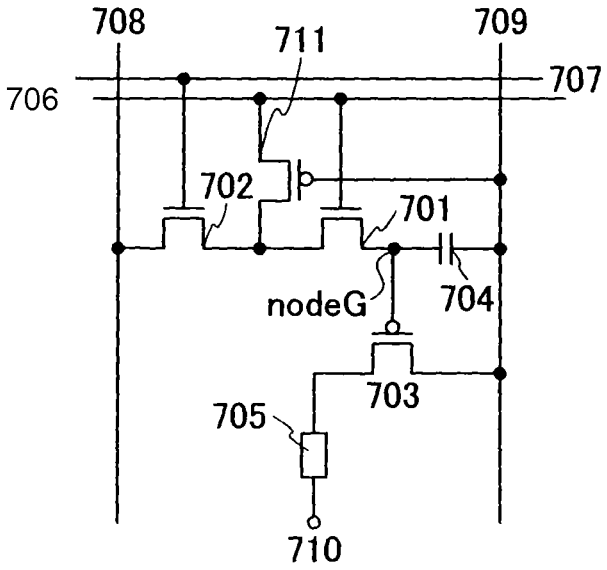
FIG. 7 is a circuit diagram of Embodiment Mode 3 of the present invention.

Another structure of the present invention, which is different from the pixel structures shown in FIGS. 1 and 5 is described in this embodiment mode. A specific structure is shown in FIG. 7 and described. Only one pixel is illustrated here, but actually a plurality of pixels is arranged in a matrix in row and column directions in a pixel portion of the semiconductor device.

According to the pixel of the present invention, three levels of potential, that is, a high potential (a High potential), a middle potential (a Middle potential), and a low potential (a Low potential) are set at a first scan line 706. In a period during which the first scan line 706 is selected, the potential of the first scan line 706 is made the high potential (High potential), a third transistor 711 and a first transistor 701 are turned on, and a potential which is obtained by subtracting an absolute value of the threshold value of the third transistor 711 from the high potential (High potential) of the first scan line 706 is taken into the node G. Next, the potential of the first scan line 706 is made the middle potential (Middle potential), the third transistor 711 is turned off. In addition, the pixel structure of this embodiment mode includes the following: a second transistor 702 controlled by the potential of a data line 708 and the potential of a second scan line 707; the first transistor 701 controlled by the potential of the first scan line 706 of the middle potential (Middle potential); a fourth transistor (also called a "driving transistor") 703 for controlling current supply from a current supply line 709 to a light-emitting element 705 depending on the potential of the node G; the third transistor 711 controlled by the potential of the first scan line 706; and a holding capacitor 704 for holding the potential of the node G. Then, in a period during which the second scan line 707 is selected, conduction between the node G and the data line is controlled by the second transistor 702 and the first transistor 701. Note that for description, the first transistor 701 and the second transistor 702 are N-channel transistors, and the third transistor 711 and the fourth transistor 703 are P-channel transistors in this embodiment mode. In addition, the light-emitting element 705 emits light by a current which flows in a direction from the current supply line 709 to a counter electrode 710. If the structure of the light-emitting element or the polarity of the transistor is changed, the connection of respective terminals of the transistors or respective signals may be arbitrary changed in the structure.

One of two electrodes of the holding capacitor 704 is connected to a gate of the fourth transistor 703 and the other thereof is connected to the current supply line 709. The holding capacitor 704 is provided in order to maintain the gate-source voltage (gate voltage) of the fourth transistor 703 more certainly; however, the holding capacitor is not necessarily provided when the potential of the node G can be held by parasitic capacitance of the fourth transistor 703 or the like. Further, the one electrode of the holding capacitor 704 is not necessarily connected to the current supply line 709 when the gate potential of the fourth transistor 703 can be held.

One of a source or a drain of the first transistor 701 is connected to the first scan line 706 through the third transistor 711, and the other of the source or the drain of the first transistor 701 is connected to a gate of the fourth transistor 703. A gate of the first transistor 701 is connected to the first scan line 706. One of a source or a drain of the second transistor 702 is connected to the data line 708, and the other of the source or the drain of the second transistor 702 is connected to the one of the source or the drain of the first transistor 701. A gate of the second transistor 702 is connected to the second scan line 707. One of a source or a drain of the third transistor 711 is connected to the first scan line 706, and the other of the source or the drain of the third transistor 711 is connected to the one of the source or the drain of the first transistor 701. A gate of the third transistor 711 is connected to the current supply line 709. One of a source or a drain of the fourth transistor 703 is connected to the current supply line 709, and the other of the source or the drain of the fourth transistor 703 is connected to a pixel electrode (not shown). One electrode of the light-emitting element 705 is connected to the pixel electrode and the other electrode thereof is connected to the counter electrode 710. One electrode of the holding capacitor 704 is connected to the gate of the fourth transistor 703 and the other electrode thereof is connected to the current supply line 709.

In this specification, the light-emitting element may have a structure interposed between the pixel electrode and the counter electrode.

In this embodiment mode, the one electrode of the light-emitting element is connected to the pixel electrode and the other electrode of the light-emitting element is connected to the counter electrode; however, such a structure in which the pixel electrode also functions as the one electrode of the light-emitting element and the counter electrode also functions as the other electrode of the light-emitting element may be used. In that case, the pixel electrode functions as an anode of the light-emitting element whereas the counter electrode functions as a cathode of the light-emitting element.

A potential Vss which is lower than the current supply line 709 is set at the counter electrode 710 of the light-emitting element 705. Note that Vss is, where the potential Vdd which is set at the current supply line 709 in a light-emitting period of the pixel is used as a criterion, a potential to satisfy Vss<Vdd; for example, Vss=GND (a ground potential).

Next, an operation method of the pixel structure shown in FIG. 7 is described using FIGS. 8A, 8B, 9A, 9B, and 10A to 10D.

Figure 8A:
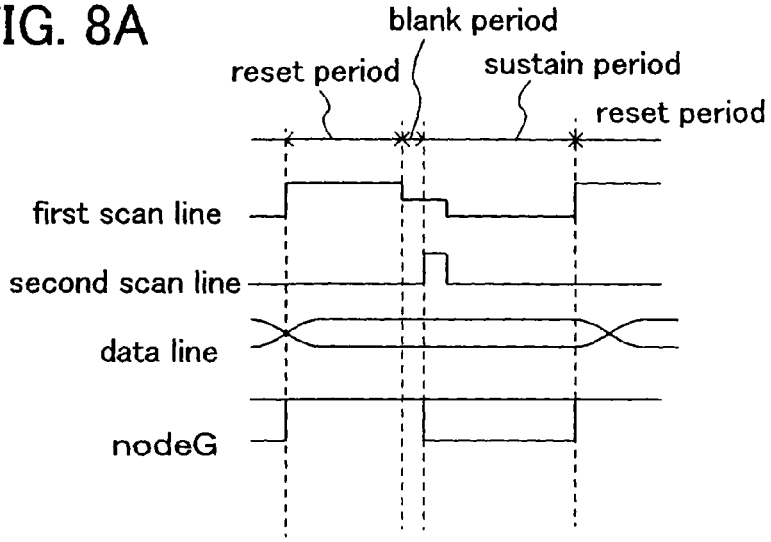
FIGS. 8A and 8B are timing charts of Embodiment Mode 3 of the present invention.
Figure 8B:
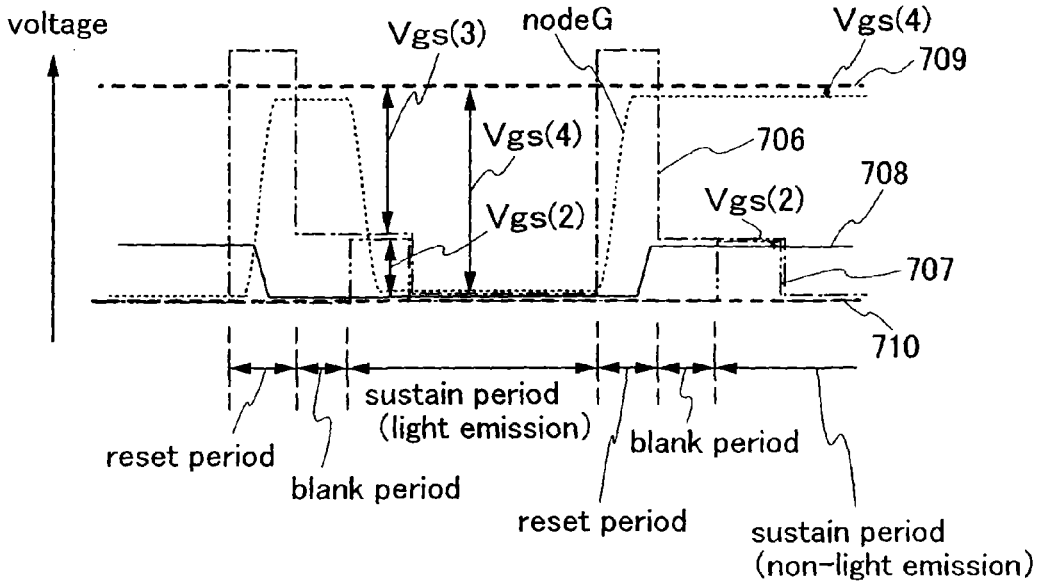

First, FIG. 8A shows a timing chart of the first scan line 706, the second scan line 707, the data line 708, and the node G in the pixel structure shown in FIG. 7 of the present invention. In the pixel structure of the present invention, a reset period, a blank period, and a sustain period (a period during which a light emitting state or a non-light emitting state starts by a data signal and is maintained by the holding capacitor until the next data signal is inputted) are provided.

In the pixel structure of the present invention, a potential for turning the driving transistor off is inputted in advance to the gate of the driving transistor, that is, the holding capacitor in the pixel. This period during which a signal for turning the driving transistor off is inputted in advance to the gate of the driving transistor in the pixel is referred to as the "reset period" in this specification.

In addition, in the pixel structure of the present invention, a signal for controlling whether the driving transistor is turned on or off is controlled by the first scan line and the second scan line. Therefore, in the pixel structure of the present invention, if the first scan line and the second scan line turn the first transistor and the second transistor on at the same time, conduction between the first scan line and the data line is permitted, which is not good. In view of this, by providing a blank period, a period during which none of the first transistor and the second transistor is turned on is provided in order to prevent conduction between the first scan line and the data line in the pixel structure of the present invention. In this embodiment mode, this period during which none of the first transistor and the second transistor is turned on by the first scan line and the second scan line is referred to as the "blank period". Of course this blank period is not necessarily provided when a switch or the like is additionally provided in order to prevent conduction between the first scan line and the data line in the pixel structure.

Using FIGS. 8B, 9A, 9B, and 10A to 10D, potential change and timing of the portions, and on/off of each transistor in the reset period, the blank period, and the sustain period are described with specific examples. Where the voltage to be applied to the light-emitting element is 8 V, the potential of the current supply line 709 is 8 V, the potential of the counter electrode 710 is 0 V, the High potential of the first scan line 706 is 10 V, the Middle potential thereof is 3 V, the Low potential thereof is 0 V, the High potential of the second scan line 707 is 3 V, the Low potential thereof is 0 V, the High potential of the data line 708 is 3 V, and the Low potential thereof is 0 V. Further, an absolute value of each threshold value of the first transistor 701, the second transistor 702, and the third transistor 711 is 1 V, and the fourth transistor 703 operates in the linear region enough.

First, as shown in FIG. 9A, in the reset period, the potential of the first scan line 706 is made High (10 V), the first transistor 701 and the third transistor 711 are turned on, the node G has a value of 9 V which is obtained by subtracting the threshold of the first transistor 701 from the potential 10 V of the first scan line 706, and the fourth transistor 703 is turned off.

Next, as shown in FIG. 9B, the blank period is provided, which prevents conduction between the first scan line 706 and the data line 708 caused by turning the second transistor 702 and the third transistor 711 on at the same time. By setting the potential of the first scan line 706 to be the middle potential (3 V) which is lower than the potential of the current supply line 709, the third transistor 711 is turned off and conduction between the first scan line 706 and the data line 708 can be prevented. In addition, before the second scan line 707 is made High (3 V), the potential of the data signal is required to be decided. The potential of the data line 708 is made Low (0 V) in the case where the light-emitting element is to emit light whereas is made High (3 V) in the case where the light-emitting element is not to emit light.

Figure 10A:
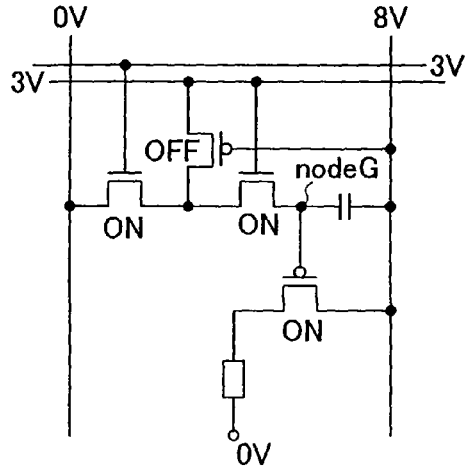
FIGS. 10A to 10D are diagrams each showing one mode of Embodiment Mode 3 of the present invention.
Figure 10B:
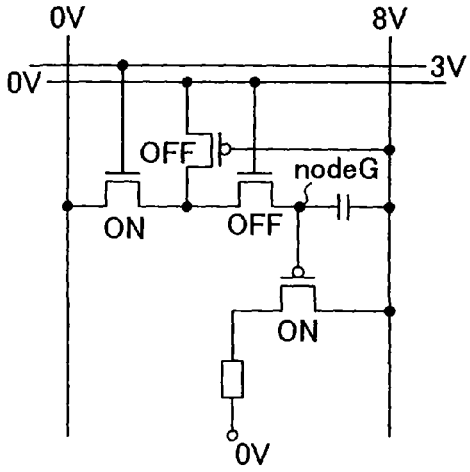
Figure 10C:
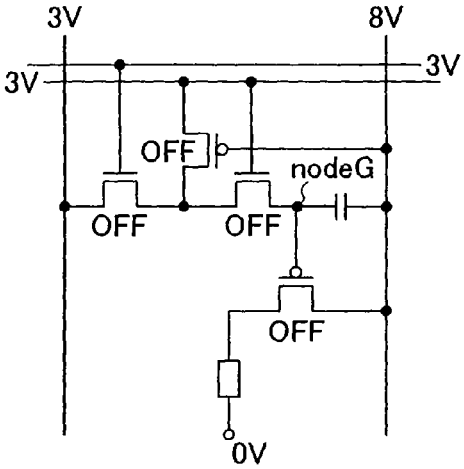
Figure 10D:
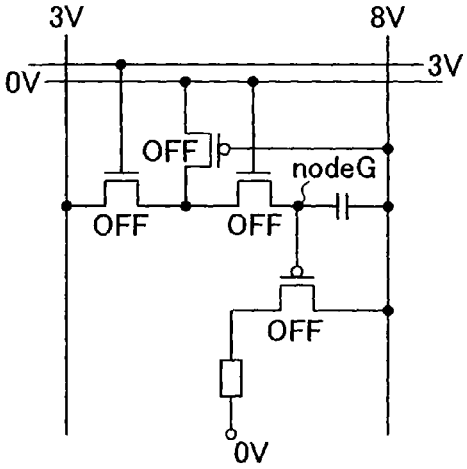

Then, as shown in FIGS. 10A to 10D, in the following sustain period, the second scan line 707 is made High (3 V), and the potential of the first scan line 706 is also the middle potential (3 V). In the case where the potential of the data line 708 is High (3 V), the second transistor 702 is turned off because the Vgs becomes 0 V, the first transistor 710 is also turned off, and the node G maintains 9 V (FIGS. 10C and 10D). When the second scan line 707 is made High (3 V), in the case where the potential of the data line 708 is Low (0 V), the second transistor 702 is turned on because the Vgs becomes 3 V, the first transistor 701 is also turned on, and the potential of the node G becomes 0 V which is the same as the data line 708 (FIGS. 10A and 10B). Accordingly, whether the potential of the node G is High (9 V) or Low (0 V) is decided, which is held for a certain period by the holding capacitor 704.

As described above, by using the pixel structure or the driving method of the semiconductor device of the present invention, to control between light emitting state and non-light emitting state of the light-emitting element depending on the data signal, the potential of the fourth transistor is the potential of the data line in a light emitting state whereas the potential of the gate of the fourth transistor is the potential of the current supply line in a non-light emitting state. Consequently, the voltage of the data line can be set to be lower, and power consumption can be drastically reduced.

This embodiment mode can be freely combined with the other embodiment modes and embodiments.

Embodiment Mode 4

Figure 11:
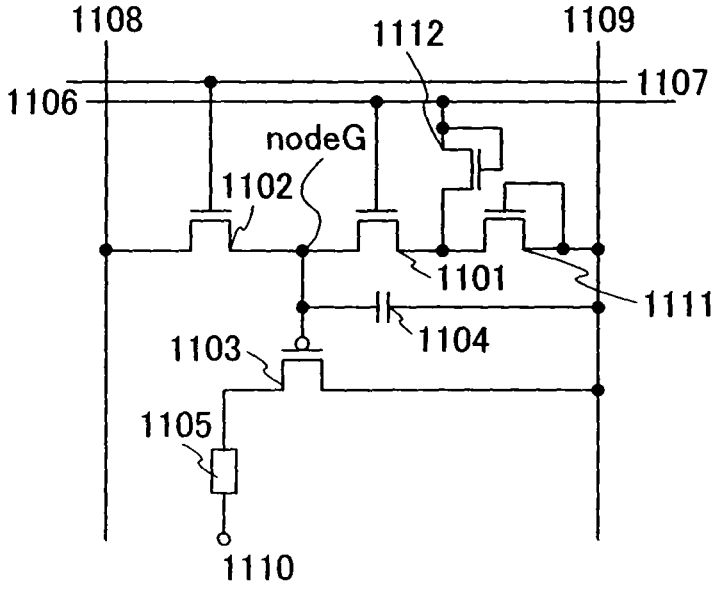
FIG. 11 is a circuit diagram of Embodiment Mode 4 of the present invention.

Another structure of the present invention, which is different from the pixel structures shown in FIGS. 1, 5, and 7 is described in this embodiment mode. A specific structure is shown in FIG. 11 and described. Only one pixel is illustrated here, but actually a plurality of pixels is arranged in a matrix in row and column directions in a pixel portion of the semiconductor device.

According to the pixel of this embodiment mode, in a period during which a first scan line 1106 is selected, a first transistor 1101 is turned on, a High potential is taken into the node G from the first scan line 1106 through a fourth transistor 1112, and a fifth transistor 1103 is turned off; the High potential of the node G is higher than the potential of a current supply line 1109, and is a potential which is obtained by subtracting an absolute value of the threshold value of the fourth transistor 1112 from the potential of the first scan line 1106. In addition, according to the pixel structure of this embodiment mode includes the following: a second transistor 1102 controlled by the potential of a data line 1108 and the potential of a second scan line 1107; the first transistor 1101; the fifth transistor (also called a "driving transistor") 1103 for controlling current supply from the current supply line 1109 to a light-emitting element 1105 depending on the potential of the node G; a third transistor 1111 controlled by the potential of a source terminal or a drain terminal; the fourth transistor 1112 controlled by the potential of the first scan line 1106; and a holding capacitor 1104 for holding the potential of the node G. Then, in a period during which the second scan line 1107 is selected, conduction between the node G and the data line is controlled by the second transistor 1102. Note that for description, the first transistor 1101, the second transistor 1102, the third transistor 1111, and the fourth transistor 1112 are N-channel transistors, and the fifth transistor 1103 is a P-channel transistor in this embodiment mode. In addition, the light-emitting element 1105 emits light by a current which flows in a direction from the current supply line 1109 to a counter electrode 1110. If the structure of the light-emitting element or the polarity of the transistor is changed, the connection of respective terminals of the transistors or respective signals may be arbitrary changed in the structure.

One of two electrodes of the holding capacitor 1104 is connected to a gate of the fifth transistor 1103 and the other thereof is connected to the current supply line 1109. The holding capacitor 1104 is provided in order to maintain the gate-source voltage (gate voltage) of the fifth transistor 1103 more certainly; however, the holding capacitor is not necessarily provided when the potential of the node G can be held by parasitic capacitance of the fifth transistor 1103 or the like. Further, the one electrode of the holding capacitor 1104 is not necessarily connected to the current supply line 1109 when the gate potential of the fifth transistor 1103 can be held.

One of a source or a drain of the first transistor 1101 is connected to the first scan line 1106 through the fourth transistor 1112, and the other of the source or the drain of the first transistor 1101 is connected to the gate of the fifth transistor 1103. A gate of the first transistor 1101 is connected to the first scan line 1106. One of a source or a drain of the second transistor 1102 is connected to the data line 1108, and the other of the source or the drain of the second transistor 1102 is connected to the gate of the fifth transistor 1103. Agate of the second transistor 1102 is connected to the second scan line 1107. One of a source or a drain of the third transistor 1111 is connected to the current supply line 1109, and the other of the source or the drain of the third transistor 1111 is connected to the one of the source or the drain of the first transistor 1101. A gate of the third transistor 1111 is connected to the current supply line 1109. One of a source or a drain of the fourth transistor 1112 is connected to the first scan line 1106, and the other of the source or the drain of the fourth transistor 1112 is connected to the one of the source or the drain of the first transistor 1101. A gate of the fourth transistor 1112 is connected to the first scan line 1106. One of a source or a drain of the fifth transistor 1103 is connected to the current supply line 1109, and the other of the source or the drain of the fifth transistor 1103 is connected to a pixel electrode (not shown). One electrode of the light-emitting element 1105 is connected to the pixel electrode and the other electrode thereof is connected to the counter electrode 1110. One electrode of the holding capacitor 1104 is connected to the gate of the fifth transistor 1103 and the other electrode thereof is connected to the current supply line 1109.

In this embodiment mode, the one electrode of the light-emitting element is connected to the pixel electrode and the other electrode of the light-emitting element is connected to the counter electrode; however, such a structure in which the pixel electrode also functions as the one electrode of the light-emitting element and the counter electrode also functions as the other electrode of the light-emitting element may be used.

A potential Vss which is lower than the current supply line 1109 is set at the counter electrode 1110 of the light-emitting element 1105. Note that Vss is, where the potential Vdd which is set at the current supply line 1109 in a light-emitting period of the pixel is used as a criterion, a potential so as to satisfy Vss<Vdd; for example, Vss=GND (a ground potential).

Next, an operation method of the pixel structure shown in FIG. 11 is described using FIGS. 12A, 12B, 13A, 13B, 14A and 14B.

Figure 12A:
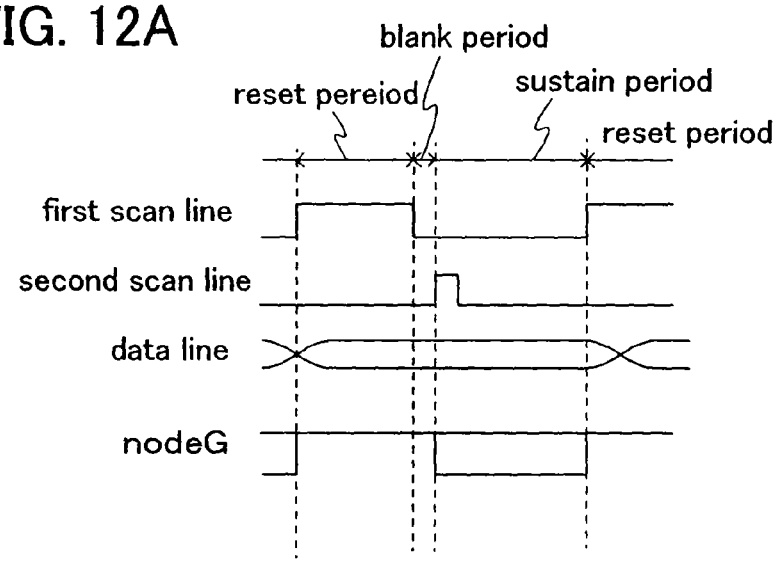
FIGS. 12A and 12B are timing charts of Embodiment Mode 4 of the present invention.
Figure 12B:
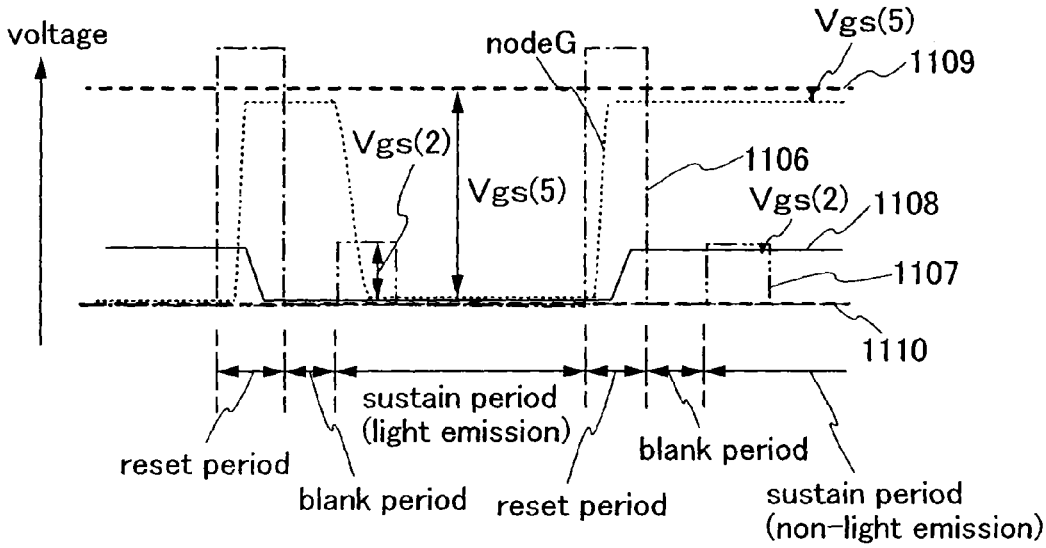

First, FIG. 12A shows a timing chart of the first scan line 1106, the second scan line 1107, the data line 1108, and the node G in the pixel structure shown in FIG. 11 of the present invention. In the pixel structure of the present invention, a reset period, a blank period, and a sustain period (a period during which a light emitting state or a non-light emitting state starts by a data signal and is maintained by the holding capacitor until the next data signal is inputted) are provided.

In the pixel structure of the present invention, a potential for turning the driving transistor off is inputted in advance to the gate of the driving transistor, that is, the holding capacitor in the pixel. This period during which a signal for turning the driving transistor off is inputted in advance to the gate of the driving transistor in the pixel is referred to as the "reset period" in this specification.

In addition, in the pixel structure of the present invention, a signal for controlling whether the driving transistor is turned on or off is controlled by the first scan line and the second scan line. Therefore, in the pixel structure of the present invention, if the first scan line and the second scan line turn the first transistor and the second transistor on at the same time, conduction between the current supply line or the first scan line 1106 and the data line is permitted, which is not good. In view of this, by providing a blank period, a period during which none of the first transistor and the second transistor is turned on is provided in order to prevent conduction to the data line in the pixel structure of the present invention. In this embodiment mode, this period during which none of the first transistor and the second transistor is turned on by the first scan line and the second scan line is referred to as the "blank period". Of course this blank period is not necessarily provided when a switch or the like is additionally provided in order to prevent conduction to the data line in the pixel structure.

Using FIGS. 12B, 13A, 13B, 14A and 14B, potential change and timing of the portions, and on/off of each transistor in the reset period, the blank period, and the sustain period are described with specific examples. Where the voltage to be applied to the light-emitting element is 8 V, the potential of the current supply line 1109 is 8 V, the potential of the counter electrode 1110 is 0 V, the High potential of the first scan line 1106 is 10 V, the Low potential thereof is 0 V, the High potential of the second scan line 1107 is 3 V, the Low potential thereof is 0 V, the High potential of the data line 1108 is 3 V, and the Low potential thereof is 0 V. Further, an absolute value of each threshold value of the first transistor 1101, the second transistor 1102, the third transistor 1111, and the fourth transistor 1112 is 1 V, and the fifth transistor 1103 operates in the linear region enough.

First, as shown in FIG. 13A, in the reset period, the potential of the first scan line 1106 is made High (10 V), the first transistor 1101 is turned on, and the node G becomes High (9 V) by the third transistor 1111 and the fourth transistor 1112. Here, the third transistor 1111 takes current from the current supply line 1109 whereas the fourth transistor 1112 takes current from the first scan line 1106; however, as for the current supply capacity, it is more advantageous to take current from the current supply line 1109 because of the wire resistance. The reason why current is taken from both of the current supply line and the first scan line is that the period of High potential of the node G is shortened and that the potential can be higher than the current supply line. As a result of this, the fifth transistor can be turned off more certainly when the light emission is stopped.

Next, as shown in FIG. 13B, the blank period is provided, which prevents conduction between the first scan line 1106 or the current supply line 1109 and the data line 1108 caused by turning the first transistor 1101 and the second transistor 1102 on at the same time. In addition, before the second scan line 1107 is made High (3 V), the potential of the data signal is required to be decided. The potential of the data line 1108 is made Low (0 V) in the case where the light-emitting element is to emit light whereas is made High (3 V) in the case where the light-emitting element is not to emit light.

Then, as shown in FIGS. 14A and 14B, in the following sustain period, the second scan line 1107 is made High (3 V), and the second transistor 1102 is turned off in the case where the potential of the data line 1108 is High (3 V) because the Vgs becomes 0 V, and the node G maintains High (9 V) (FIG. 14B). When the second scan line 1107 is made High (3 V), in the case where the potential of the data line 1108 is Low (0 V), the second transistor 1102 is turned on because the Vgs becomes 3 V, and the potential of the node G becomes 0 V which is the same as the data line 1108 (FIG. 14A). Accordingly, whether the potential of the node G is High (9 V) or Low (0 V) is decided, which is held for a certain period by the holding capacitor 1104.

As described above, by using the pixel structure or the driving method of the semiconductor device of the present invention, to control between light emitting state and non-light emitting state of the light-emitting element depending on the data signal, the potential of the data line is the gate potential of the fifth transistor for driving in a light emitting state whereas the potential of the current supply line is the gate of the fifth transistor for driving in a non-light emitting state. Consequently, the voltage of the data line can be set to be lower, and power consumption can be drastically reduced.

This embodiment mode can be freely combined with the other embodiment modes and embodiments.

Embodiment 1

Figure 15:
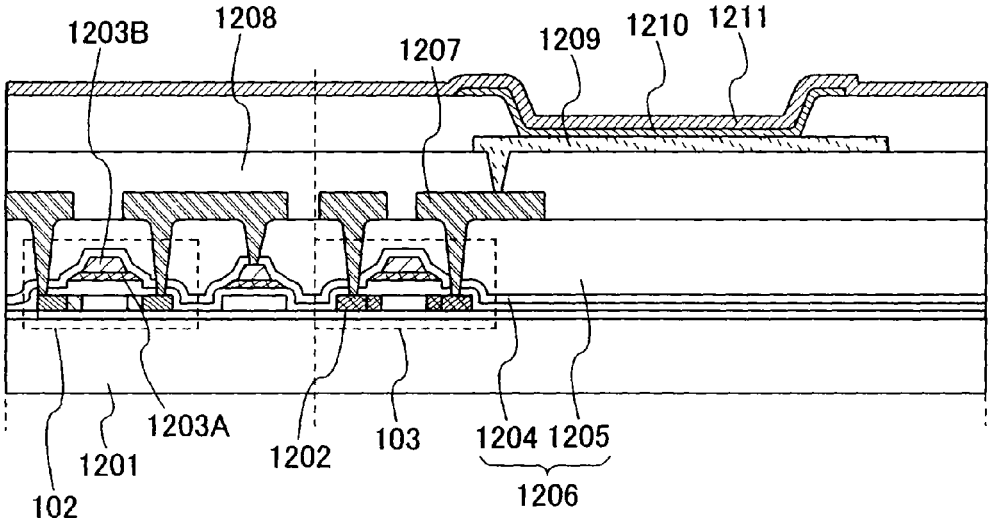
FIG. 15 is a cross-sectional view of Embodiment 1 of the present invention.

A cross-sectional structure of a light-emitting device equipped with the semiconductor device of the present invention is described with reference to the drawing. Here, a cross section of a multilayer structure of a light-emitting device including the second transistor for selecting, the third transistor for driving, and the light-emitting element shown in FIG. 1 is described with reference to FIG. 15 in order.

As a substrate 1201 having an insulating surface, a glass substrate, a quartz substrate, a stainless steel substrate, or the like can be used. A substrate formed of a flexible synthetic resin such as acrylic or plastic typified by polyethylene terephthalate (PET), polyethylene naphthalate (PEN), or the like can also be used as long as the substrate can resist treatment temperature in the manufacturing process.

First, a base film is formed over the substrate 1201. The base film can be formed by using an insulating film of silicon oxide, silicon nitride, silicon nitride oxide, or the like. Next, an amorphous semiconductor film is formed over the base film. The thickness of the amorphous semiconductor film is in the range of 25 to 100 nm. Not only silicon but also silicon germanium can be used as the material of the amorphous semiconductor film. Subsequently, the amorphous semiconductor film is crystallized as necessary, thereby forming a crystalline semiconductor film 1202. As the crystallization method, a heating furnace, laser irradiation, irradiation with light emitted from a lamp, or a combination thereof can be used. For example, a metal element is added to the amorphous semiconductor film and a heat treatment is conducted using a heating furnace to form the crystalline semiconductor film. Adding a metal element as described above is preferable because the crystallization can be carried out at a low temperature.

Since a thin film transistor (TFT) formed of a crystalline semiconductor has higher electric field effect mobility and larger ON current than a TFT formed of an amorphous semiconductor, the TFT formed of a crystalline semiconductor is more suitable for a semiconductor device.

Next, patterning is carried out to shape the crystalline semiconductor film 1202 into a predetermined form. Then, an insulating film functioning as a gate insulating film is formed. The insulating film is formed in thickness from 10 to 150 nm so as to cover the semiconductor film. For example, a silicon oxynitride film, a silicon oxide film, or the like can be formed in either a single layer structure or a multilayer structure.

Next, a conductive film functioning as a gate electrode is formed with the gate insulating film interposed therebetween. The gate electrode may have either a single layer structure or a multilayer structure, and here the gate electrode is formed by stacking plural conductive films. Conductive films 1203A and 1203B are each formed of an element selected from Ta, W, Ti, Mo, Al, and Cu, or an alloy or compound material containing any one of the above elements as its main component. In this embodiment, the conductive film 1203A is formed of a tantalum nitride film with a thickness of 10 to 50 nm and the conductive film 1203B is formed of a tungsten film with a thickness of 200 to 400 nm.

Next, an impurity element is added using the gate electrode as a mask, thereby forming an impurity region. At this time, a low-concentration impurity region may be formed in addition to a high-concentration impurity region. The low-concentration impurity region is called an LDD (Lightly Doped Drain) region.

Next, insulating films 1204 and 1205 functioning as an interlayer insulating film are formed. The insulating film 1204 is preferably an insulating film containing nitrogen, and here is formed of a silicon nitride film with a thickness of 100 nm by plasma CVD. The insulating film 1205 is preferably formed of an organic material or an inorganic material. As the organic material, polyimide, acrylic, polyamide, polyimide-amide, benzocyclobutene, or siloxane can be used. Siloxane has a skeletal structure with a bond of silicon (Si) and oxygen (O). As a substituent, an organic group containing at least hydrogen (e.g., an alkyl group or aromatic hydrocarbon) is used. As the substituent, a fluoro group may also be used. Alternatively, a fluoro group and an organic group containing at least hydrogen may be used as the substituents. As the inorganic material, an insulating film containing oxygen or nitrogen, such as a silicon oxide (SiOx) film, a silicon nitride (SiNx) film, a silicon oxynitride (SiOxNy) (x>y; x and y are natural numbers) film, or a silicon nitride oxide (SiNxOy) (x>y; x and y are natural numbers) film can be used. It is noted that a film formed of an organic material has favorable flatness whereas the organic material absorbs moisture or oxygen; in order to prevent the absorption, an insulating film containing an inorganic material is preferably formed over the insulating film formed of an organic material.

Next, after forming a contact hole in an interlayer insulating film 1206, a conductive film 1207 which functions as a source wire and a drain wire of a transistor is formed. The conductive film 1207 can be formed of an element selected from aluminum (Al), titanium (Ti), molybdenum (Mo), tungsten (W), and silicon (Si), or an alloy film containing any of these elements. In this embodiment, the conductive film 1207 is formed of a multilayer film including a titanium film, a titanium nitride film, a titanium-aluminum alloy film, and a titanium film.

Next, an insulating film 1208 is formed so as to cover the conductive film. The insulating film 1208 can be formed of the material mentioned as the material of the interlayer insulating film 1206. Next, a pixel electrode (also called a first electrode) 1209 is formed in an opening provided in the insulating film 1208. In the opening, in order to improve step coverage of the pixel electrode 1209, an edge surface of the opening preferably has a round shape so as to have a plurality of radii of curvature.

The pixel electrode 1209 is preferably formed of a conductive material such as metal, alloy, an electrically conductive compound, or a mixture thereof, each having a high work function (a work function of 4.0 eV or higher). As a specific example of the conductive material, indium oxide containing tungsten oxide (IWO), indium zinc oxide containing tungsten oxide (IWZO), indium oxide containing titanium oxide (ITiO), indium tin oxide containing titanium oxide (ITTiO), or the like can be given. Needless to say, indium tin oxide (ITO), indium zinc oxide (IZO), indium tin oxide with silicon oxide added (ITSO), or the like can also be used.

An example of composition ratio of the conductive material is described below. The composition ratio of indium oxide containing tungsten oxide may be tungsten oxide:indium oxide=1.0 wt %:99.0 wt %. The composition ratio of indium zinc oxide containing tungsten oxide may be tungsten oxide: zinc oxide:indium oxide=1.0 wt %:0.5 wt %:98.5 wt %. The composition ratio of indium oxide containing titanium oxide may be titanium oxide:indium oxide=1.0 to 5.0 wt %:99.0 to 95.0 wt %. The composition ratio of indium tin oxide (ITO) may be tin oxide:indium oxide=10.0 wt %:90.0 wt %. The composition ratio of indium zinc oxide (IZO) may be zinc oxide:indium oxide=10.7 wt %:89.3 wt %. The composition ratio of indium tin oxide containing titanium oxide may be titanium oxide:tin oxide:indium oxide=5.0 wt %:10.0 wt %:85.0 wt %. These composition ratios are just examples, and the composition ratio may be appropriately determined.

Next, an electroluminescent layer 1210 is formed by an evaporation method or an ink jet method. The electroluminescent layer 1210 is formed of an organic material or an inorganic material by appropriately combining an electron-injecting layer (EIL), an electron-transporting layer (ETL), a light-emitting layer (EML), a hole-transporting layer (HTL), a hole-injecting layer (HIL), or the like. The boundary between the layers is not necessarily clear; in some cases, respective materials of the layers are partially mixed so that the interface is unclear.

The electroluminescent layer is preferably constituted from a plurality of layers having different functions, such as a hole-injecting/transporting layer, a light-emitting layer, and an electron-injecting/transporting layer.

The hole-injecting/transporting layer is preferably formed of a composite material containing an organic compound material having a hole-transporting property and an inorganic compound material having an electron-receiving property with respect to the organic compound material. This structure generates a large number of hole carriers in an organic compound which originally has almost no inherent carriers, to provide an excellent hole-injecting/transporting property. Accordingly, the driving voltage can be lower than conventional driving voltage. Further, since the hole-injecting/transporting layer can be made thick without increasing the driving voltage, short circuit of the light-emitting element caused by dust or the like can be reduced.

As an organic compound material having a hole-transporting property, for example, copper phthalocyanine (abbreviated to CuPc), vanadyl phthalocyanine (abbreviated to VOPc), 4,4',4"-tris(N,N-diphenylamino)triphenylamine (abbreviated to TDATA), 4,4',4"-tris[N-(3-methylphenyl)-N-phenylamino]triphenylamine (abbreviated to MTDATA), 1,3,5-tris[N,N-di(m-tolyl)amino]benzene (abbreviated to m-MTDAB), N,N'-diphenyl-N,N'-bis(3-methylphenyl)-1,1'-biphenyl-4,4'-diamine (abbreviated to TPD), 4,4'-bis[N-(1-naphthyl)-N-phenylamino]biphenyl (abbreviated to NPB), 4,4'-bis{N-[4-di(m-tolyl)amino]phenyl-N-phenylamino}biphenyl (abbreviated to DNTPD), 4,4',4"-tris(N-carbazolyl)triphenylamine (abbreviated to TCTA), or the like is given; the organic compound material is not limited to the above.

As the inorganic compound material having an electron-receiving property, titanium oxide, zirconium oxide, vanadium oxide, molybdenum oxide, tungsten oxide, rhenium oxide, ruthenium oxide, zinc oxide, or the like is given. In particular, vanadium oxide, molybdenum oxide, tungsten oxide, or rhenium oxide is preferable because it can be formed using vacuum evaporation and easily treated.

An electron-injecting/transporting layer is formed of an organic compound material having an electron-transporting property. Specifically, tris(8-quinolinolato) aluminum (abbreviated to $Alq_3$), tris(4-methyl-8-quinolinolato)aluminum (abbreviated to $Almq_3$), bis(10-hydroxybenzo[h]-quinolinato)beryllium (abbreviated to $BeBq_2$), bis(2-methyl-8-quinolinolato)(4-phenylphenolato)aluminum (abbreviated to BAlq), bis[2-(2'-hydroxyphenyl)benzoxazolato]zinc (abbreviated to $Zn(BOX)_2$), bis[2-(2'-hydroxyphenyl)benzothiazolato]zinc (abbreviated to $Zn(BTZ)_2$), bathophenanthroline (abbreviated to BPhen), bathocuproin (abbreviated to BCP), 2-(4-biphenylyl)-5-(4-tert-butylphenyl)-1,3,4-oxadiazole (abbreviated to PBD), 1,3-bis[5-(4-tert-butylphenyl)-1,3,4-oxadiazole-2-yl]benzene (abbreviated to OXD-7), 2,2',2"-(1,3,5-benzenetriyl)-tris(1-phenyl-1H-benzoimidazole) (abbreviated to TPBI), 3-(4-biphenylyl)-4-phenyl-5-(4-tert-butylphenyl)-1,2,4-triazole (abbreviated to TAZ), 3-(4-biphenylyl)-4-(4-ethylphenyl)-5-(4-tert-butylphenyl)-1,2,4-triazole (abbreviated to p-EtTAZ), or the like is given; the organic compound material is not limited to the above.

As the light-emitting layer, the following can be given as an example: 9,10-di(2-naphthyl)anthracene (abbreviated to DNA), 9,10-di(2-naphthyl) -2-tert-butylanthracene (abbreviated to t-BuDNA), 4,4'-bis(2,2-diphenylvinyl)biphenyl (abbreviated to DPVBi), coumarin 30, coumarin 6, coumarin 545, coumarin 545T, perylene, rubrene, periflanthene, 2,5,8,11-tetra(tert-butyl)perylene (abbreviated to TBP), 9,10-diphenylanthracene (abbreviated to DPA), 5,12-diphenyltetracene, 4-(dicyanomethylene)-2-methyl-[p-(dimethylamino)styryl]-4H-pyran (abbreviated to DCM1), 4-(dicyanomethylene)-2-methyl-6-[2-(julolidine-9-yl)ethenyl]-4H-pyran (abbreviated to DCM2), 4-(dicyanomethylene)-2,6-bis[p-(dimethylamino)styryl]-4H-pyran (abbreviated to BisDCM), or the like. In addition, the following compound capable of emitting phosphorescence can also be used: bis[2-(4',6'-difluorophenyl)pyridinato-N,$C^{2'}$]iridium (picolinate) (abbreviated to FIrpic), bis{2-[3',5'-bis(trifluoromethyl)phenyl]pyridinato-N,$C^{2'}$}iridium(picolinate) (abbreviated to $Ir(CF_3\ ppy)_2(pic)$), tris(2-phenylpyridinato-N,$C^{2'}$)iridium (abbreviated to $Ir(Ppy)_3$), bis(2-phenylpyridinato-N,$C^{2'}$)iridium(acetylacetonate) (abbreviated to $Ir(ppy)_2(acac)$), bis[2-(2'-thienyl)pyridinato-N,$C^{3'}$]iridium(acetylacetonate) (abbreviated to $Ir(thp)_2(acac)$), bis(2-phenylquinolinato-N,$C^{2'}$)iridium(acetylacetonate) (abbreviated to $Ir(pq)_2(acac)$), bis[2-(2'-benzothienyl)pyridinato-N,$C^{3'}$]iridium(acetylacetonate) (abbreviated to $Ir(btp)_2(acac)$), or the like.

The light-emitting layer may use a singlet excited light-emitting material and a triplet excited material including a metal complex or the like. For example, among a red light-emitting pixel, a green light-emitting pixel, and a blue light-emitting pixel, the red light-emitting pixel whose luminance half-reduced period is relatively short is formed of a triplet-excited light-emitting material and the others are formed of a singlet-excited light-emitting material. Because of high luminous efficiency, power consumption of a triplet-excited light-emitting material is less than that of a singlet-excited light-emitting material to obtain the same luminance. That is, if the red light-emitting pixel is formed of a triplet-excited light-emitting material, reliability thereof can be improved because the amount of current for flowing into the light-emitting element of the red light-emitting pixel is small. In order to reduce the power consumption, the red light-emitting pixel and the green light-emitting pixel may be formed of a triplet-excited light-emitting material and the blue light-emitting pixel may be formed of a singlet-excited light-emitting material. By forming the green light-emitting element, which has high visibility to human eyes, of a triplet-excited light-emitting material, further reduction in power consumption can be achieved.

The light-emitting layer may have a structure for displaying in colors by forming a light-emitting layer with a different light emission wavelength band for each pixel. Typically, light-emitting layers each corresponding to each color of R (red), G (green), and B (blue) are formed. Even in this case, by providing a filter for passing light with the light emission wavelength band, on a light emission side of the pixel, color purity can be increased and reflection (glare) of the pixel portion can be prevented. By providing the filter, it is possible to omit a circular polarizing plate or the like which has been conventionally required and to avoid loss of light emitted from the light-emitting layer. Moreover, change of color tone which occurs when the pixel portion (display screen) is viewed obliquely can be decreased.

In addition, as an electroluminescent material applicable to the light-emitting layer, a high molecular weight material such as a polyparaphenylenevinylene-based material, a polyparaphenylene-based material, a polythiophene-based material, a polyfluorene-based material, or the like is given.

In any way, the layer structure of the electroluminescent layer can be modified. Within the scope for achieving the function as the light-emitting element, such modification is allowable that a predetermined hole or electron injecting/transporting layer or a light-emitting layer is replaced with an electrode layer having the same purpose or a light-emitting material is provided by being diffused.

Moreover, a color filter (colored layer) may be formed over a sealing substrate. The color filter (colored layer) can be formed by an evaporation method or a droplet discharging method. By using the color filter (colored layer), high-definition display can also be carried out because the color filter (colored layer) can correct a broad peak in a light-emission spectrum of each color of RGB so as to be a sharp peak.

Further, full-color display can be achieved by forming a material of emitting a single color and combining the material with a color filter or a color conversion layer. The color filter (colored layer) or the color conversion layer may be formed over, for example, a second substrate (a sealing substrate) and attached to the substrate 1201.

Then, a counter electrode (also called a second electrode) 1211 is formed by a sputtering method or an evaporation method. One of the pixel electrode 1209 or the counter electrode 1211 functions as an anode while the other functions as a cathode.

As a cathode material, it is preferable to use metal, alloy, an electrically conductive compound, a mixture thereof, or the like each having a low work function (a work function of 3.8 eV or lower). As a specific example of the cathode material, an element belonging to Group 1 or 2 in the periodic table, i.e., alkali metal such as Li or Cs, alkaline earth metal such as Mg, Ca, or Sr, alloy containing the above metal such as Mg:Ag or Al:Li, a compound containing the above metal such as LiF, CsF, or $CaF_2$, or transition metal containing rare-earth metal can be used. However, the cathode needs to have a light-transmitting property, and thus the above metal or alloy containing the metal is formed extremely thin and another metal (including alloy) such as ITO is stacked thereover.

After that, a protective film formed of a silicon nitride film or a DLC (Diamond-Like Carbon) film may be provided so as to cover the counter electrode 1211. Through the above steps, the light-emitting device of the present invention is completed.

This embodiment can be freely combined with the other embodiment modes and embodiments. That is, a potential at which the driving transistor is turned on can be supplied from the data line, whereas a potential at which the driving transistor is turned off can be supplied from another wire such as the current supply line, both of the potentials are applied to the gate of the driving transistor. Accordingly, the voltage of the data line can be set to be lower, and power consumption can be drastically reduced.

Embodiment 2

In this embodiment, an example of an active matrix display using the pixel structure of the present invention is described with reference to FIG. 16.

The active matrix display includes a substrate 501 over which a transistor and a wire are formed, an FPC 508 for connecting the wire to the outside, a light-emitting element, and a counter substrate 502 for sealing the light-emitting element.

The substrate 501 includes a display portion 506 including a plurality of pixels arranged in a matrix, a data line driver circuit 503, a scan line driver circuit A 504, a scan line driver circuit B 505, and an FPC connection portion 507 which is connected to the FPC 508 into which various power sources and signals are inputted.

The data line driver circuit 503 has circuits such as a shift register, a latch, a level shifter, and a buffer, which outputs data to a data line of each column. Each of the scan line driver circuit A 504 and the scan line driver circuit B 505 has circuits such as a shift register, a level shifter, and a buffer. The scan line driver circuit A 504 outputs a selection pulse sequentially to a second scan line of each row while the scan line driver circuit B 505 outputs a selection pulse sequentially to a first scan line of each row.

Whether the light-emitting element emits light or not is controlled in accordance with a data signal which is written in each pixel in the timing at which the selection pulses are outputted from the scan line driver circuit A 504 and the scan line driver circuit B 505.

In addition to the above driver circuits, circuits such as a CPU and a controller may be integrally formed over the substrate 501. This makes it possible to decrease the number of external circuits (ICs) to be connected and further reduce the weight and thickness, which is particularly effective for mobile terminals and the like.

Figure 16:
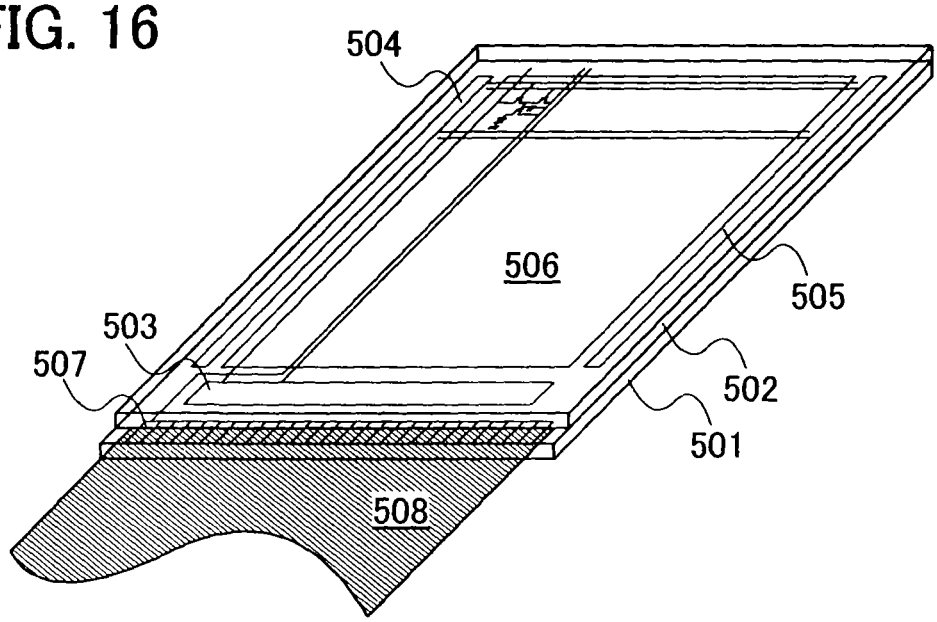
FIG. 16 is a perspective view of Embodiment 2 of the present invention.

In this specification, a panel to which the steps up to the step of attaching the FPC have been carried out and which uses an EL element for the light-emitting element as shown in FIG. 16, is referred to as an EL module.

This embodiment can be freely combined with the other embodiment modes and embodiments. That is, a potential at which the driving transistor is turned on can be supplied from the data line, whereas a potential at which the driving transistor is turned off can be supplied from another wire such as the current supply line, both of the potentials are applied to the gate of the driving transistor. Accordingly, the voltage of the data line can be set to be lower, and power consumption can be drastically reduced.

Embodiment 3

In this embodiment, an example in which the potential of the current supply line is corrected to suppress an effect by fluctuation of a current value of the light-emitting element caused by change in ambient temperature and change over time is described.

A light-emitting element has such a property that its resistance value (internal resistance value) is changed depending on the ambient temperature. Specifically, when the room temperature is set as a normal temperature, if the temperature is higher than normal, the resistance value decreases whereas if the temperature is lower than normal, the resistance value increases. Therefore, if the temperature increases, the current value increases, causing the luminance to exceed the desired luminance. Meanwhile, if the temperature decreases, in the case of applying the same voltage as that in the former, the current value decreases, causing the luminance to fall to below the desired luminance. The light-emitting element has also such a property that the current value decreases over time. Specifically, when a light-emission period and a non-light-emission period are accumulated, the resistance value increases with deterioration of the light-emitting element. Thus, if the light-emission period and the non-light-emission period are accumulated, in the case of applying the same voltage, the current value decreases, causing the luminance to fall to below the desired luminance.

Because of the above-mentioned properties of the light-emitting element, the luminance varies because of the change in ambient temperature or the change over time. In this embodiment, by correcting with the potential of the current supply line of the present invention, an effect by fluctuation in the current value of the light-emitting element caused by the change in ambient temperature and the change over time can be suppressed.

Figure 17:
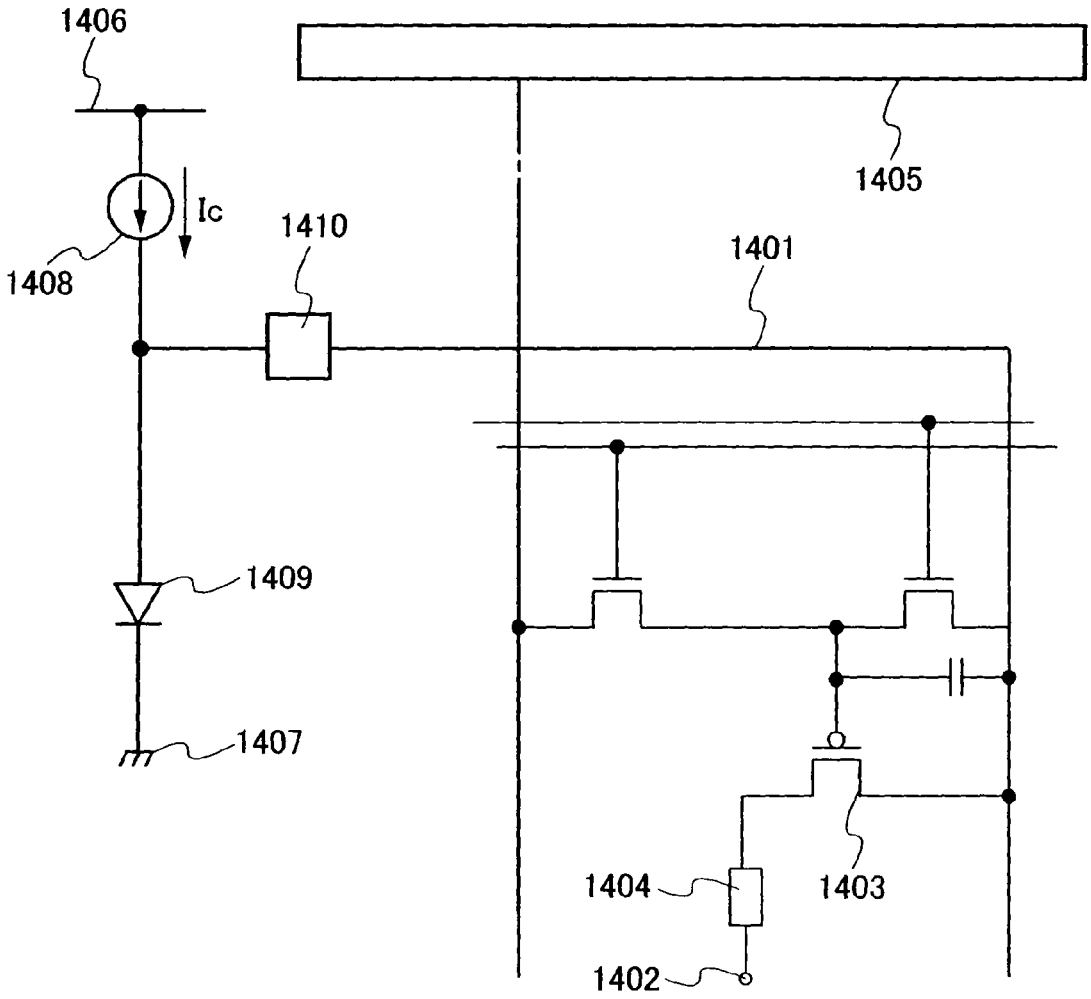
FIG. 17 is a circuit diagram of Embodiment 3 of the present invention.

FIG. 17 shows a circuit structure. In a pixel, the semiconductor device shown in FIG. 1 is provided. The description of the same portions as those in FIG. 1 is omitted. In FIG. 17, a current supply line 1401 and a counter electrode 1402 are connected to each other through a third transistor for driving 1403 and a light-emitting element 1404. Then, current flows from the current supply line 1401 to the counter electrode 1402. The light-emitting element 1404 emits light in accordance with the amount of current flowing from the current supply line 1401 to the counter electrode 1402.

In the case of such a pixel structure, if the potentials of the current supply line 1401 and the counter electrode 1402 are fixed and current keeps flowing to the light-emitting element 1404, the characteristic of the light-emitting element 1404 deteriorates. Moreover, the characteristic of the light-emitting element 1404 changes depending on the temperature.

Specifically, if current keeps flowing to the light-emitting element 1404, the voltage-current characteristic is shifted gradually. That is, the resistance value of the light-emitting element 1404 increases even though the same amount of voltage is applied, so that the value of flowing current gets smaller. Moreover, although when the same amount of current flows, the luminous efficiency decreases to lower the luminance. As for the temperature characteristic, if the temperature decreases, the voltage-current characteristic of the light-emitting element 1404 shifts, which raises the resistance value of the light-emitting element 1404.

In view of the above, the above-mentioned deterioration and effect by the fluctuation are corrected by using a monitor circuit. In this embodiment, by adjusting the potential of the current supply line 1401, the deterioration and effect by the fluctuation by the temperature of the light-emitting element 1404 are corrected.

Here, a structure of the monitor circuit is described. A first monitor power source line 1406 and a second monitor power source line 1407 are connected to each other through a monitor current source 1408 and a monitor light-emitting element 1409. To a connection point of the monitor light-emitting element 1409 and the monitor current source 1408, an input terminal of a sampling circuit 1410 for outputting the potential of the monitor light-emitting element 1409 is connected. To an output terminal of the sampling circuit 1410, the current supply line 1401 is connected. Therefore, the potential of the current supply line 1401 is controlled by the output of the sampling circuit 1410.

Next, operation of the monitor circuit is described. First, the monitor current source 1408 supplies current with the amount required to be supplied to the light-emitting element 1404 which emits light with the largest number of grayscales. The current value at this time is denoted by Imax.

Then, at both ends of the monitor light-emitting element 1409, the voltage with the level required to supply current with the amount of Imax is applied. If the voltage-current characteristic of the monitor light-emitting element 1409 changes in accordance with the deterioration, the temperature, or the like, the voltage to be applied at both the ends of the monitor light-emitting element 1409 also changes to be optimum. Accordingly, the effect of the fluctuation (e.g., deterioration or temperature change) in the monitor light-emitting element 1409 can be corrected.

To the input terminal of the sampling circuit 1410, the voltage to be applied to the monitor light-emitting element 1409 is inputted. Accordingly, the potential of the output terminal of the sampling circuit 1410, i.e., the potential of the current supply line 1410 is corrected by the monitor circuit, whereby the fluctuation of the light-emitting element 1404 by the deterioration or the temperature can be corrected.

The sampling circuit 1410 may be any kind of circuit as long as the voltage in accordance with the inputted current can be outputted. For example, a voltage follower circuit is also a kind of an amplifier circuit, but the present invention is not limited to this. The circuit may be constituted using any one of an operational amplifier, a bipolar transistor, and a MOS transistor or a combination of them.

The monitor light-emitting element 1409 is desirably formed over the same substrate, at the same time, and by the same manufacturing method as the light-emitting element 1404 of the pixel, because the correction would be misaligned if the characteristic were different in the monitor light-emitting element and the light-emitting element arranged in the pixel.

Since the light-emitting element 1404 arranged in the pixel often has a period during which current does not flow, if current keeps flowing to the monitor light-emitting element 1409, deterioration progresses in the monitor light-emitting element 1409 larger than in the light-emitting element 1404. Therefore, the potential to be outputted from the sampling circuit 1410 is excessively corrected. Accordingly, the degree of deterioration of the monitor light-emitting element 1409 can be controlled in accordance with the actual degree of deterioration of the light-emitting element 1404 arranged in the pixel. the potential outputted from the sampling circuit 1410 may follow the actual degree of deterioration of the pixel. For example, if the lighting ratio of the whole screen is 30% on average, current may be supplied to the monitor light-emitting element 1409 for the period corresponding to a luminance of 30%. At that time, the monitor light-emitting element 1409 has a period during which current does not flow; however, it is necessary to supply voltage constantly from the output terminal of the sampling circuit 1410. In order to achieve this, the input terminal of the sampling circuit 1410 may be provided with a capacitor where the potential generated when current is supplied to the monitor light-emitting element 1409 is held.

If the monitor circuit is operated in accordance with the largest number of grayscales, the excessively corrected potential is outputted. However, since burning-in at the pixel (variation in luminance caused by fluctuation in the degree of deterioration per pixel) becomes unnoticeable, it is desirable that the monitor circuit be operated in accordance with the largest number of grayscales.

In this embodiment, it is more preferable that the third transistor for driving 1403 be operated in the linear region. The third transistor for driving 1403 is operated approximately as a switch by being operated in the linear region. Therefore, it is possible to suppress the effect of the fluctuation in the characteristic by the deterioration, temperature, and the like of the third transistor for driving 1403. In the case of operating the third transistor for driving 1403 only in the linear region, whether current flows into the light-emitting element 1404 or not is often controlled in a digital manner. In this case, in order to increase the number of grayscales, it is preferable to combine a time grayscale method, an area grayscale method, or the like.

This embodiment can be freely combined with the other embodiment modes and embodiments.

Embodiment 4

As electronic equipment equipped with the semiconductor device of the present invention, a television receiving appliance, a video camera, a digital camera, a goggle type display, a navigation system, a sound reproducing device (such as a car audio component), a computer, a game machine, a mobile information terminal (such as a mobile computer, a mobile phone, a mobile game machine, or an electronic book), an image reproducing device equipped with a recording medium (specifically, a device for reproducing a recording medium such as a digital versatile disk (DVD), which is equipped with a display for displaying the reproduced image), or the like is given. Specific examples of the electronic equipment are shown in FIGS. 18, 19, 20A, 20B, 21A, 21B, 22, and 23A to 23E.

Figure 18:
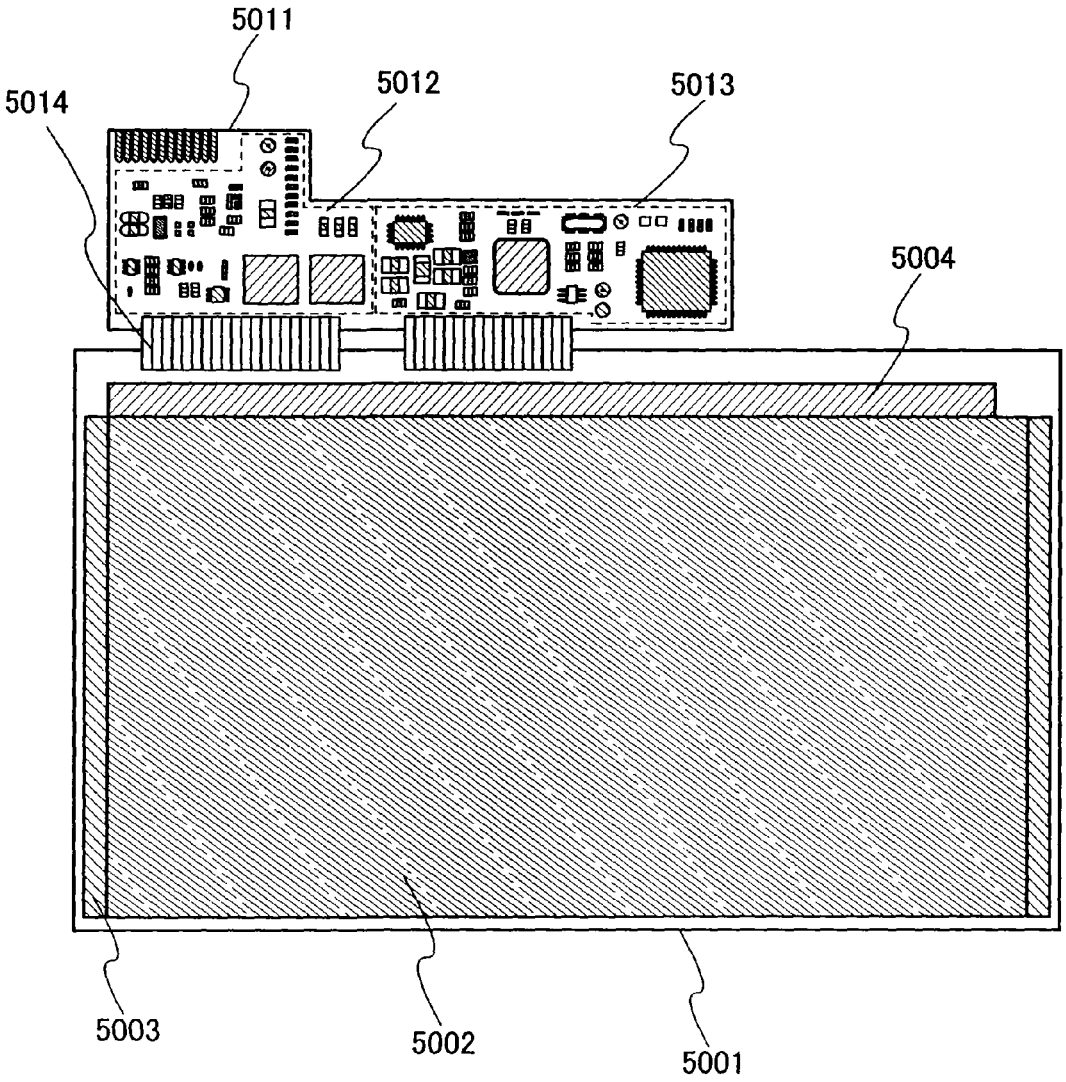
FIG. 18 is a diagram of electrical equipment of Embodiment 4 of the present invention.

FIG. 18 shows an EL module in which a display panel 5001 and a circuit substrate 5011 are combined. Over the circuit substrate 5011, a control circuit 5012, a signal dividing circuit 5013, and the like are formed, and the display panel 5001 and the circuit substrate 5011 are connected to each other with a connection wire 5014.

This display panel 5001 is provided with a pixel portion 5002 in which a plurality of pixels are provided, a scan line driver circuit 5003, and a signal line driver circuit 5004 for supplying a video signal to the selected pixel. In the case of manufacturing an EL module, a semiconductor device in which a pixel in the pixel portion 5002 is constituted using the above embodiment mode may be manufactured. Further, control driver circuit portions such as the scan line driver circuit 5003 and the signal line driver circuit 5004 can be manufactured by using TFTs formed by the above embodiment. Thus, an EL module television shown in FIG. 18 can be completed.

Figure 19:
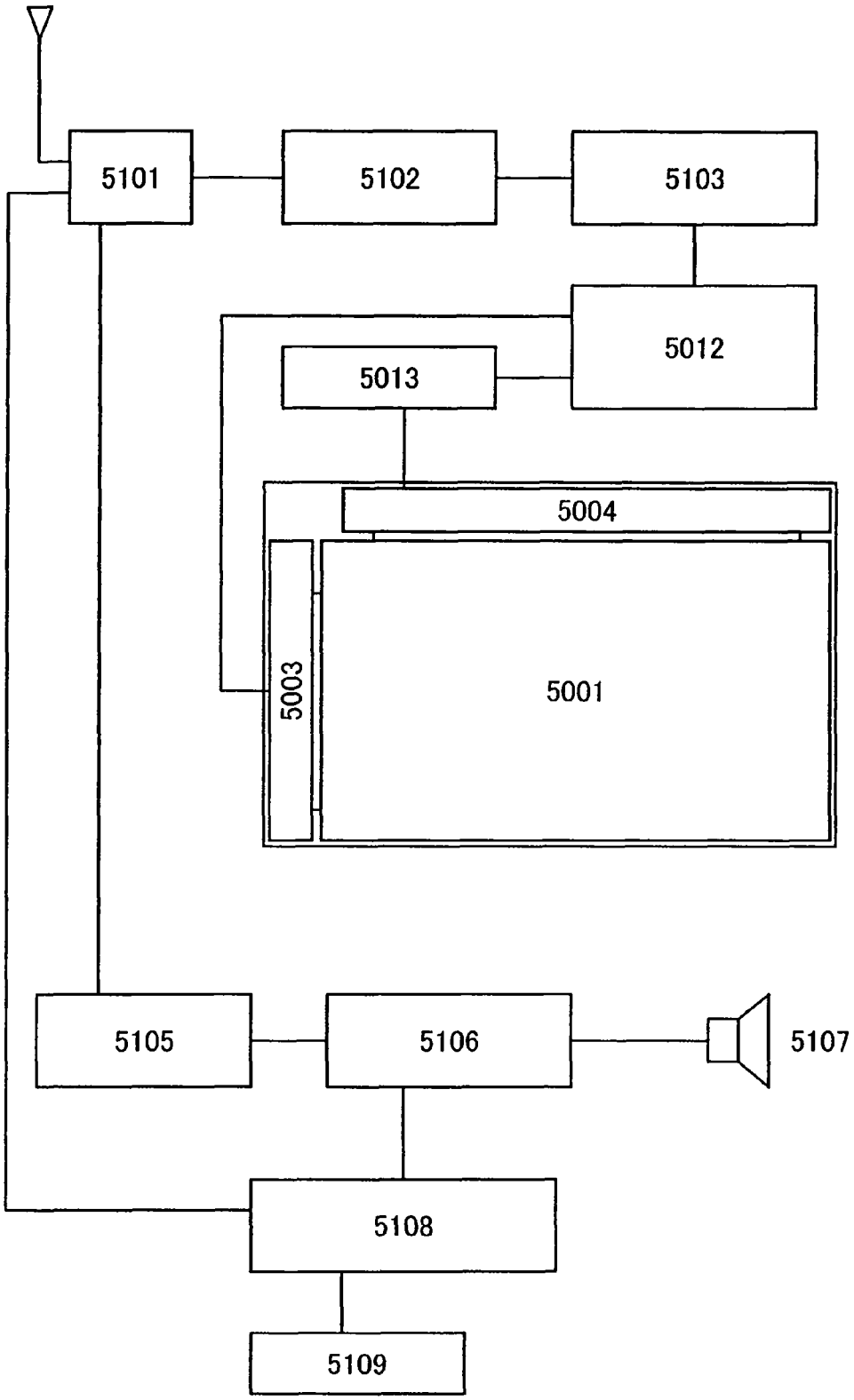
FIG. 19 is a diagram of electrical equipment of Embodiment 4 of the present invention.

FIG. 19 is a block diagram showing a main constitution of an EL television receiving machine. A video signal and an audio signal are received with a tuner 5101. The video signal is processed by a video signal amplifying circuit 5102, a video signal processing circuit 5103 for converting a signal outputted from the video signal amplifying circuit 5102 into a color signal corresponding to red, green, or blue, and a control circuit 5012 for converting the video signal in accordance with an input specification of a driver IC. The control circuit 5012 outputs signals to a scan line side and a signal line side respectively. In the case of digital driving, the signal dividing circuit 5013 may be provided on the signal line side, so that the inputted digital signal may be divided into m in number to supply.

Among the signals received with the tuner 5101, an audio signal is sent to an audio signal amplifying circuit 5105 and outputted to a speaker 5107 through an audio signal processing circuit 5106. A control circuit 5108 receives control information such as a receiving station (a receiving frequency) or volume from an input portion 5109 and sends a signal to the tuner 5101 or the audio signal processing circuit 5106.

Figure 20A:
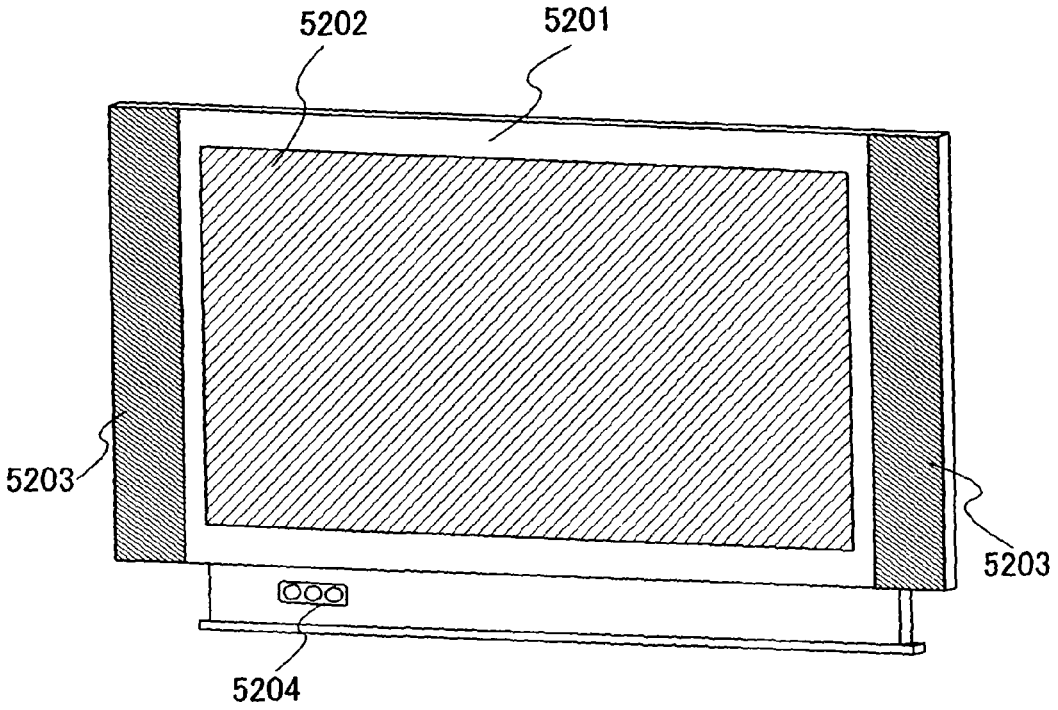
FIGS. 20A and 20B are diagrams of electrical equipment of Embodiment 4 of the present invention.

As shown in FIG. 20A, a television receiving machine can be completed by incorporating an EL module in a housing 5201. With the EL module, a display screen 5202 is formed. Further, a speaker 5203, an operation switch 5204, and the like are appropriately provided.

Figure 20B:
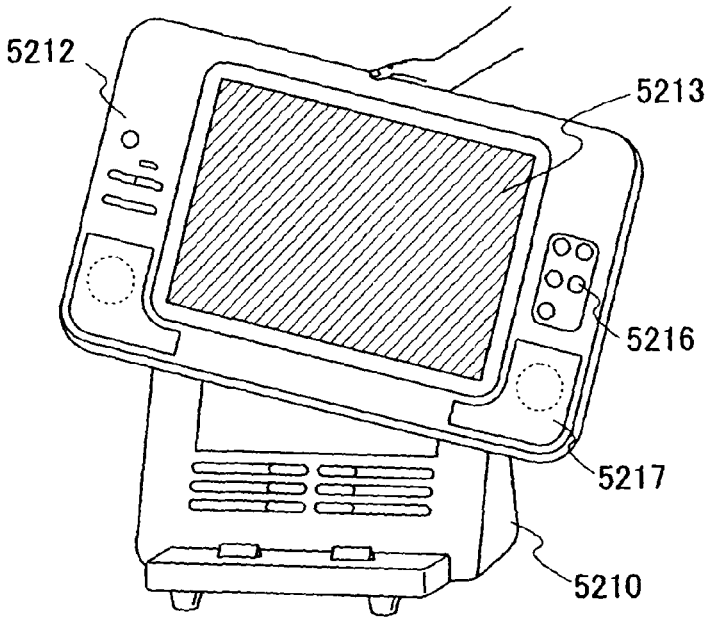

FIG. 20B shows a television receiving appliance of which only a display can be wirelessly carried. A housing 5212 incorporates a battery and a signal receiver, and a display portion 5213 and a speaker portion 5217 are driven with the battery. The battery can be repeatedly charged with a battery charger 5210. The battery charger 5210 can send and receive a video signal and can send the video signal to the signal receiver in the display. The housing 5212 is controlled by an operation key 5216. Since the appliance shown in FIG. 20B can send a signal from the housing 5212 to the battery charger 5210 by operating the operation key 5216, the appliance can also be referred to as a two-way video/audio communication device. Moreover, by operating the operation key 5216, a signal can be sent from the housing 5212 to the battery charger 5210 and the signal can be further sent from the battery charger 5210 to another electronic appliance, so that communication control of the another electronic appliance is also possible. Therefore, it is also referred to as a general-purpose remote control device. The present invention can be applied to the display portion 5213.

By using the semiconductor device of the present invention in the television receiving appliances shown in FIGS. 18, 19, 20A and 20B, it is possible to separately set the on/off potential to be applied to a gate electrode of a driving transistor and the potential of the amplitude of a data line in a pixel of a display portion. Therefore, the amplitude of the data line can be set to be small, whereby a semiconductor device with power consumption drastically suppressed can be provided. Accordingly, a product with power consumption drastically suppressed can be provided to customers.

Needless to say, the present invention is not limited to the television receiving appliance, and the present invention can be applied for various purposes, such as monitors of personal computers, particularly, large display media like information displaying boards at railway stations or airports, or advertisement display boards on streets.

Figure 21A:
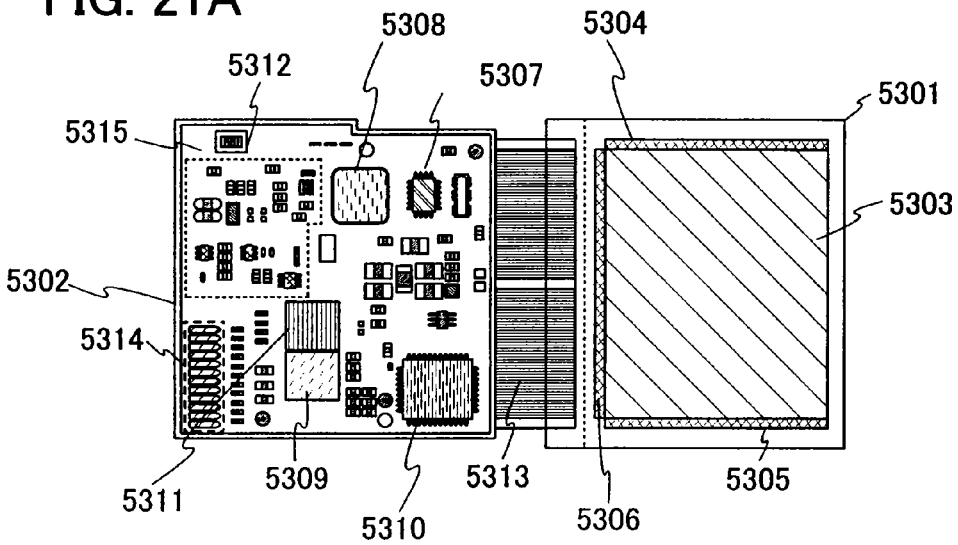
FIGS. 21A and 21B are diagrams of electrical equipment of Embodiment 4 of the present invention.

FIG. 21A shows a module in which a display panel 5301 and a printed circuit board 5302 are combined. The display panel 5301 is provided with a pixel portion 5303 in which a plurality of pixels are provided, a first scan line driver circuit 5304, a second scan line driver circuit 5305, and a signal line driver circuit 5306 for supplying a video signal to a selected pixel.

The printed circuit board 5302 is provided with a controller 5307, a central processing unit (CPU) 5308, a memory 5309, a power source circuit 5310, an audio processing circuit 5311, a sending/receiving circuit 5312, and the like. The printed circuit board 5302 and the display panel 5301 are connected to each other by a flexible wire substrate (FPC) 5313. The flexible wire substrate 5313 may be provided with a capacitor, a buffer circuit, or the like so that noise on a power source voltage or a signal, or a delay of the signal rise time can be prevented. Moreover, the controller 5307, the audio processing circuit 5311, the memory 5309, the central processing unit 5308, the power source circuit 5310, and the like can be mounted to the display panel 5301 by a COG (Chip On Glass) method. By the COG method, scale of the printed circuit board 5302 can be reduced.

Various control signals are inputted/outputted through an interface portion (I/F) 5314 provided for the printed circuit board 5302. Moreover, an antenna port 5315 for sending/receiving a signal to/from the antenna is provided for the printed circuit board 5302.

Figure 21B:
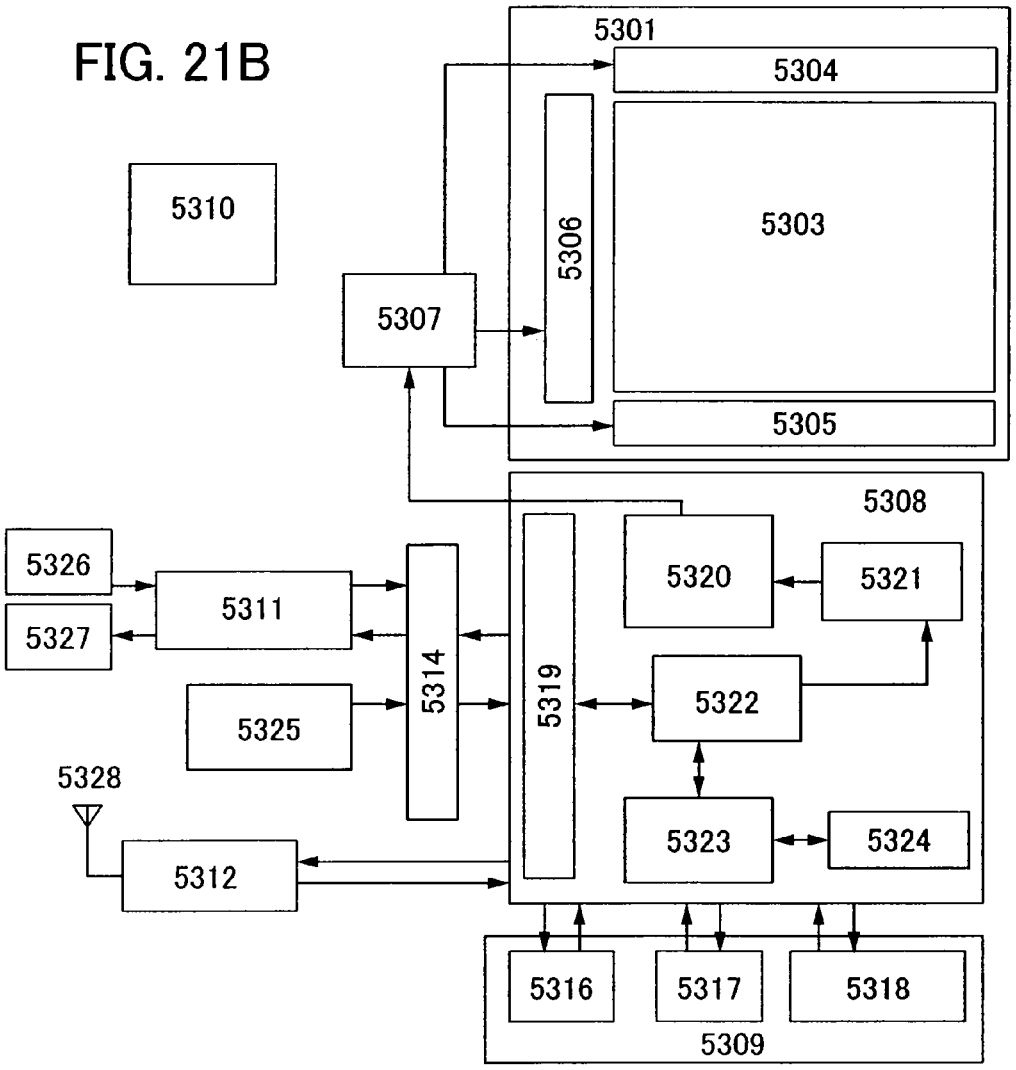

FIG. 21B is a block diagram of the module shown in FIG. 21A. This module includes a VRAM 5316, a DRAM 5317, a flash memory 5318, or the like as the memory 5309. The VRAM 5316 stores image data to be displayed on the panel, the DRAM 5317 stores image data or audio data, and the flash memory 5318 stores various programs.

The power source circuit 5310 supplies electric power for operating the display panel 5301, the controller 5307, the central processing unit 5308, the audio processing circuit 5311, the memory 5309, and the sending/receiving circuit 5312. The power source circuit 5310 is provided with a current source depending on the specification of the panel.

The central processing unit 5308 includes a control signal generating circuit 5320, a decoder 5321, a register 5322, an arithmetic circuit 5323, a RAM 5324, an interface 5319 for the central processing unit 5308, and the like. Various signals inputted to the central processing unit 5308 through the interface 5319 are inputted to the arithmetic circuit 5323, the decoder 5321, and the like after being held in the register 5322 once. The arithmetic circuit 5323 performs operation based on the inputted signal and specifies an address to send various instructions to. Meanwhile, the signal inputted to the decoder 5321 is decoded and inputted to the control signal generating circuit 5320. The control signal generating circuit 5320 generates a signal including various instructions based on the inputted signal and sends the signal to the address specified by the arithmetic circuit 5323, specifically to the memory 5309, the sending/receiving circuit 5312, the audio processing circuit 5311, the controller 5307, or the like.

The memory 5309, the sending/receiving circuit 5312, the audio processing circuit 5311, and the controller 5307 operate in accordance with the received instructions. Hereinafter the operation is briefly described.

A signal inputted from an inputting means 5325 is sent to the central processing unit 5308 mounted on the printed circuit board 5302 through the interface portion 5314. The control signal generating circuit 5320 converts image data stored in the VRAM 5316 into a predetermined format in accordance with the signal sent from the inputting means 5325 such as a pointing device or a keyboard and sends the converted image data to the controller 5307.

The controller 5307 performs data processing to the signal including the image data which has been sent from the central processing unit 5308, in accordance with the specification of the panel and supplies the signal to the display panel 5301. The controller 5307 generates a Hsync signal, a Vsync signal, a clock signal CLK, alternating voltage (AC Cont), and a switching signal L/R based on the power source voltage inputted from the power source circuit 5310 and the various signals inputted from the central processing unit 5308, and supplies these signals to the display panel 5301.

The sending/receiving circuit 5312 processes a signal which is sent/received as an electric wave with an antenna 5328 and specifically includes a high-frequency circuit such as an isolator, a bandpass filter, a VCO (Voltage Controlled Oscillator), an LPF (Low Pass Filter), a coupler, or a balun. Among the signals sent to or received from the sending/receiving circuit 5312, a signal including audio information is sent to the audio processing circuit 5311 in accordance with the instruction from the central processing unit 5308.

The signal including audio information which has been sent in accordance with the instruction of the central processing unit 5308 is demodulated into an audio signal in the audio processing circuit 5311 and sent to a speaker 5327. An audio signal which has been sent from a microphone 5326 is modulated in the audio processing circuit 5311 and sent to the sending/receiving circuit 5312 in accordance with an instruction from the central processing unit 5308.

The controller 5307, the central processing unit 5308, the power source circuit 5310, the audio processing circuit 5311, and the memory 5309 can be mounted as a package in this embodiment. This embodiment can be applied to any circuit other than a high-frequency circuit such as an isolator, a bandpass filter, a VCO (Voltage Controlled Oscillator), an LPF (Low Pass Filter), a coupler, or a balun.

Figure 22:
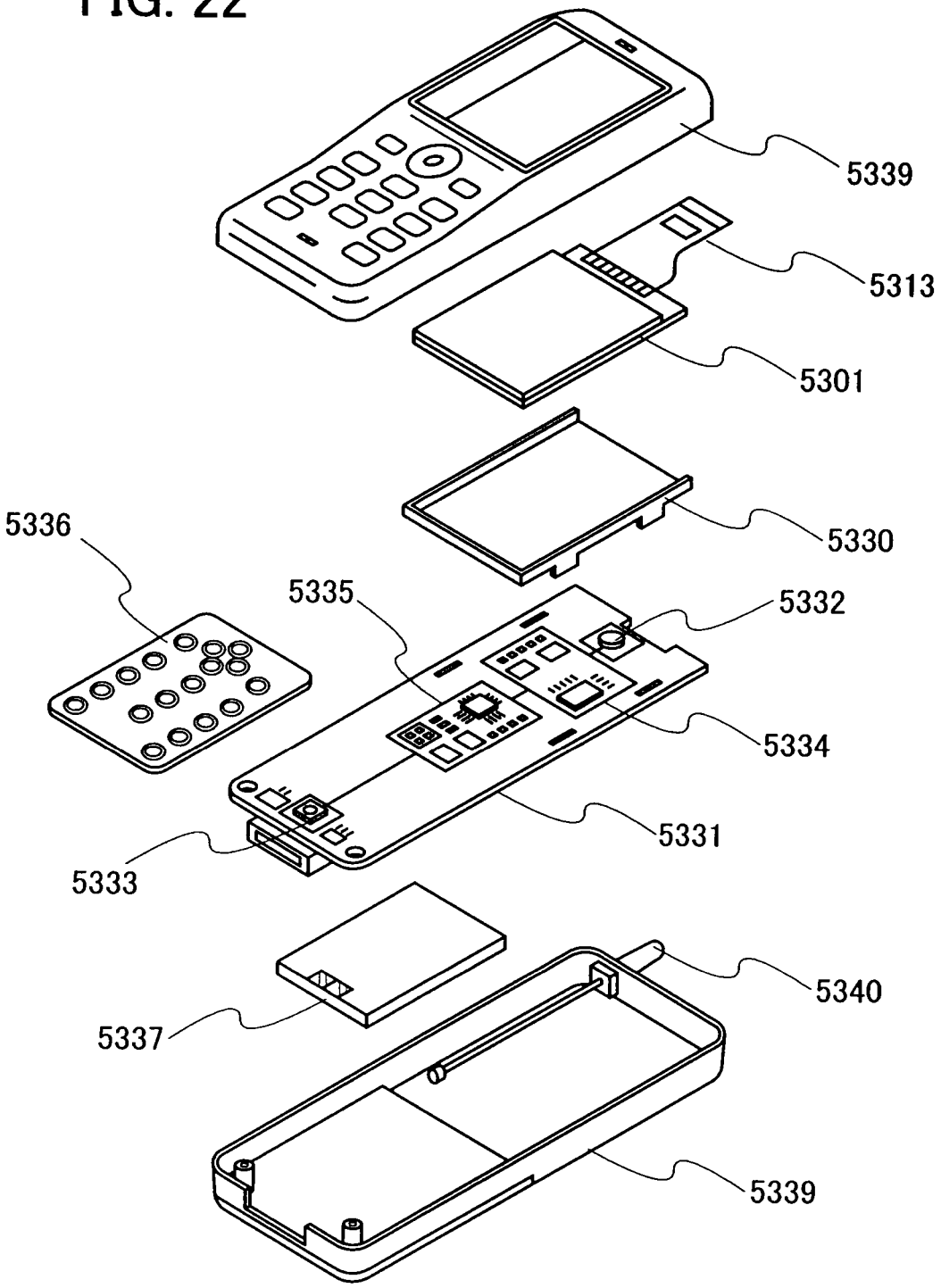
FIG. 22 is a diagram of electrical equipment of Embodiment 4 of the present invention.

FIG. 22 shows one mode of a mobile phone including the module shown in FIGS. 21A and 21B. The display panel 5301 is detachably incorporated in a housing 5330. The housing 5330 can have any shape and size in accordance with the size of the display panel 5301. The housing 5330 with the display panel 5301 fixed is fitted into a printed substrate 5331 and assembled as a module.

The display panel 5301 is connected to the printed substrate 5331 through the flexible wire substrate 5313. The printed substrate 5331 is provided with a speaker 5332, a microphone 5333, a sending/receiving circuit 5334, and a signal processing circuit 5335 including a central processing unit, a controller, and the like. Such a module is combined with an inputting means 5336, a battery 5337, and an antenna 5340 and placed in a housing 5339. A pixel portion of the display panel 5301 is provided so as to be seen from an opening window formed in the housing 5339.

The mobile phone of this embodiment can be changed into various modes in accordance with function and intended purpose thereof. For example, a plurality of display panels may be provided, or the housing may be divided into plural in number appropriately and may be connected with a hinge so as to open and close.

The mobile phone shown in FIG. 22 has a structure in which semiconductor devices similar to that described in Embodiment Mode 1 are arranged in a matrix in the display panel 5301. In the semiconductor device, the potential for controlling whether a driving transistor is turned on or off to be applied to a gate electrode of the driving transistor and the potential of amplitude of a data line in the pixel can be separately set. Therefore, the amplitude of a signal to be inputted to the data line can be set small and power consumption of the semiconductor device can be drastically suppressed. Since the display panel 5301 constituted from the semiconductor device has a similar characteristic, drastic reduction of power consumption is achieved in the mobile phone. According to such characteristics, a product with power consumption drastically suppressed can be provided to customers.

Figure 23A:
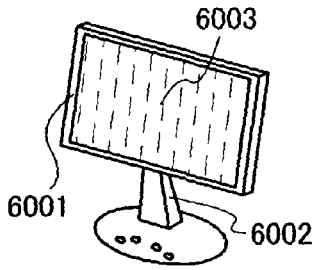
FIGS. 23A to 23E are diagrams of electrical equipment of Embodiment 4 of the present invention.

FIG. 23A shows a television device including a housing 6001, a support base 6002, a display portion 6003, and the like. In this television device, semiconductor devices similar to that described in Embodiment Mode 1 are arranged in a matrix in the display portion 6003. In the semiconductor device, the potential for controlling whether a driving transistor is turned on or off to be applied to a gate electrode of the driving transistor and the potential of amplitude of a data line in a pixel can be separately set. Therefore, the amplitude of a signal to be inputted to the data line can set to be low, thereby the power consumption of the semiconductor device can be drastically suppressed. Since the display portion 6003 constituted from the semiconductor device has a similar characteristic, drastic reduction of power consumption is achieved in the television device. According to such characteristics, a product with power consumption drastically suppressed can be provided to customers.

Figure 23B:
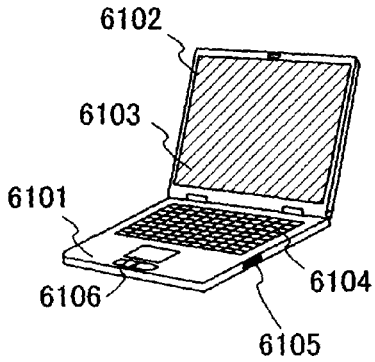

FIG. 23B shows a computer including a main body 6101, a housing 6102, a display portion 6103, a keyboard 6104, an external connection port 6105, a pointing mouse 6106, and the like. In this computer, semiconductor devices similar to that described in Embodiment Mode 1 are arranged in a matrix in the display portion 6103. In the semiconductor device, the potential for controlling whether a driving transistor is tuned on or off to be applied to a gate electrode of the driving transistor and the potential of amplitude of a data line in a pixel can be separately set. Therefore, the amplitude of a signal to be inputted to the data line can set to be low, thereby the power consumption of the semiconductor device can be drastically suppressed. Since the display portion 6103 constituted from the semiconductor device has a similar characteristic, drastic reduction of power consumption is achieved in the computer. According to such characteristics, a product with power consumption drastically suppressed can be provided to customers.

Figure 23C:
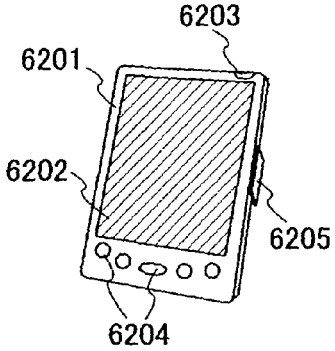

FIG. 23C shows a mobile computer including a main body 6201, a display portion 6202, a switch 6203, operation keys 6204, an infrared port 6205, and the like. In this mobile computer, semiconductor devices similar to that described in Embodiment Mode 1 are arranged in a matrix in the display portion 6202. In the semiconductor device, the potential for controlling whether a driving transistor is tuned on or off to be applied to a gate electrode of the driving transistor and the potential of amplitude of a data line in a pixel can be separately set. Therefore, the amplitude of a signal to be inputted to the data line can be set to be low, thereby the power consumption of the semiconductor device can be drastically suppressed. Since the display portion 6202 constituted from the semiconductor device has a similar characteristic, drastic reduction of power consumption is achieved in this mobile computer. According to such characteristics, a product with power consumption drastically suppressed can be provided to customers.

Figure 23D:
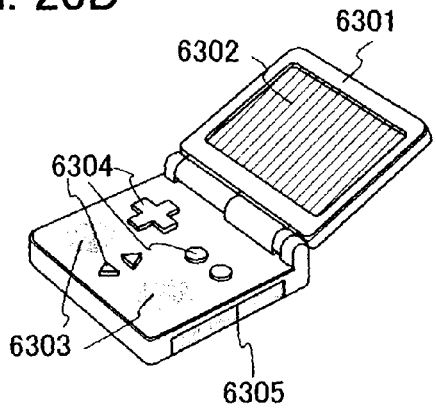

FIG. 23D shows a mobile game machine including a housing 6301, a display portion 6302, speaker portions 6303, operation keys 6304, a recording medium inserting portion 6305, and the like. In this mobile game machine, semiconductor devices similar to that described in Embodiment Mode 1 are arranged in a matrix in the display portion 6302. In the semiconductor device, the potential for controlling whether a driving transistor is turned on or off to be applied to a gate electrode of the driving transistor and the potential of amplitude of a data line in a pixel can be separately set. Therefore, the amplitude of a signal to be inputted to the data line can be set to be low, thereby the power consumption of the semiconductor device can be drastically suppressed. Since the display portion 6302 constituted from the semiconductor device has a similar characteristic, drastic reduction of power consumption is achieved in this mobile game machine. According to such characteristics, a product with power consumption drastically suppressed can be provided to customers.

Figure 23E:
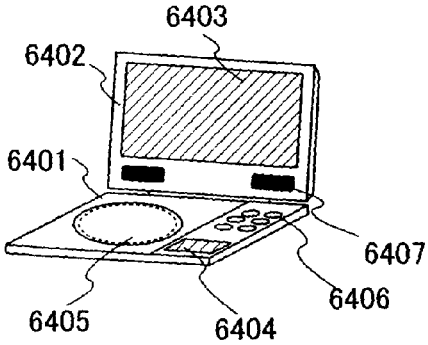
Figure 24A:
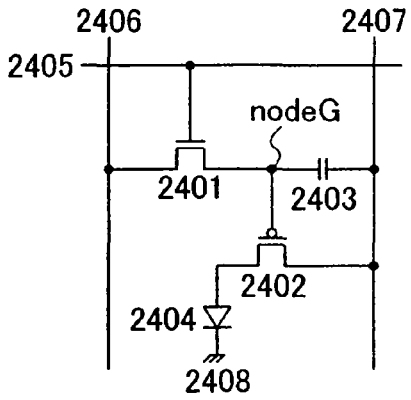
FIGS. 24A to 24C are diagrams showing a conventional example of the present invention.
Figure 24B:
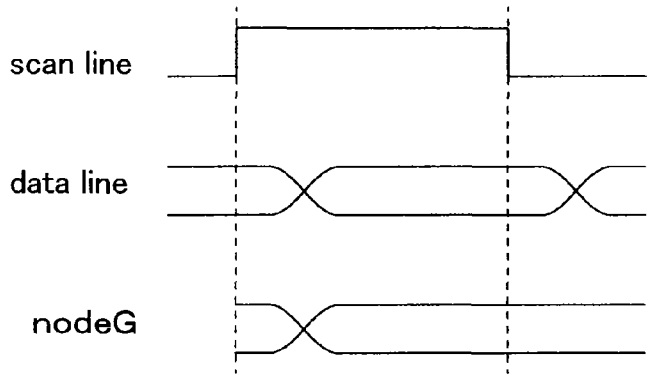
Figure 24C:
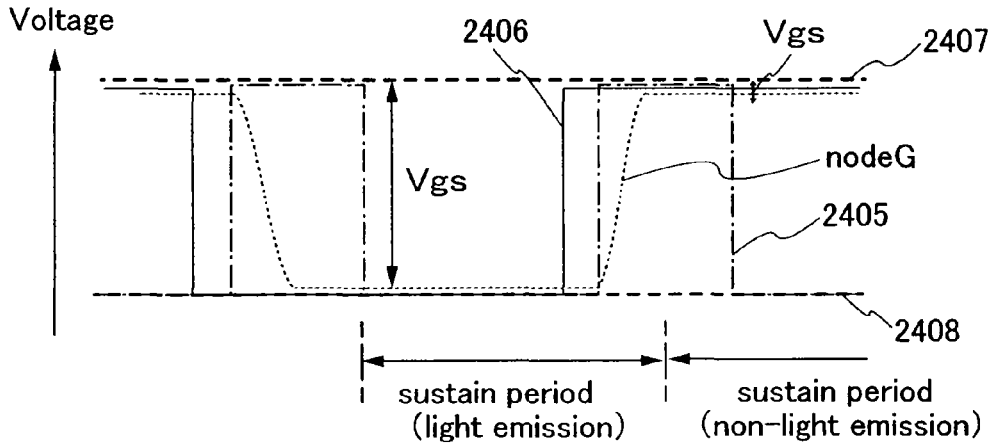

FIG. 23E shows a mobile image reproducing device equipped with a recording medium (specifically a DVD reproducing device), including a main body 6401, a housing 6402, a display portion A 6403, a display portion B 6404, a recording medium (such as a DVD) reading portion 6405, an operation key 6406, a speaker portion 6407, and the like. The display portion A 6403 mainly displays image information while the display portion B 6404 mainly displays text information. In this image reproducing device, semiconductor devices similar to that described in Embodiment Mode 1 are arranged in a matrix in the display portion A 6403 and the display portion B 6404. In the semiconductor device, the potential for controlling whether a driving transistor is tuned on or off to be applied to a gate electrode of the driving transistor and the potential of amplitude of a data line in a pixel can be separately set. Therefore, the amplitude of a signal inputted to the data line can be set to be low, thereby the power consumption of the semiconductor device can be drastically suppressed. Since each of the display portion A 6403 and the display portion B 6404 constituted from the semiconductor device has a similar characteristic, drastic reduction of power consumption is achieved in this image reproducing device. According to such characteristics, a product with power consumption drastically suppressed can be provided to customers.

The display devices used in such electronic appliances can be formed using not only a glass substrate but also a heat-resistant plastic substrate depending on the size, strength, and intended purpose; consequently, further reduction in weight can be achieved.

Although the examples described in this embodiment are just examples, the present invention is not limited to the above-described purposes.

This embodiment can be combined freely with any description of the above embodiment modes and embodiments.

This application is based on Japanese Patent Application serial no. 2005303756 filed in Japan Patent Office on 18, Oct., 2005, the entire contents of which are hereby incorporated by reference.

What is claimed is:

1. A semiconductor device comprising:

a first transistor to which a first scan signal is applied to a gate through a first scan line, wherein the gate of the first transistor is connected to the first scan line;

a second transistor to which a second scan signal is applied to a gate through a second scan line;

a third transistor which is turned on or off depending on a potential of a current supply line, wherein either a source or a drain of the third transistor is connected to the first scan line;

a fourth transistor which is turned on or off depending on a first signal and a second signal applied to a gate;

a pixel electrode; and a light-emitting element which emits light by a driving current which flows between the pixel electrode and a counter electrode, wherein the first signal supplied through the first transistor and the third transistor from the first scan line is a signal which cuts an electrical connection between the current supply line and the pixel electrode through the fourth transistor; and wherein the second signal supplied through the second transistor from a data line is a signal which makes the current supply line and the pixel electrode electrically connected to each other through the fourth transistor.

2. The semiconductor device according to claim 1, wherein a holding capacitor is provided between the gate of the fourth transistor and the current supply line.

3. The semiconductor device according to claim 1, wherein the first transistor and the second transistor are N-channel transistors and the third transistor and the fourth transistor are P-channel transistors.

4. A semiconductor device comprising:

a first transistor to which a first scan signal is applied to a gate through a first scan line, wherein the gate of the first transistor is connected to the first scan line;

a second transistor to which a second scan signal is applied to a gate through a second scan line;

a third transistor which is turned on or off depending on a potential of a current supply line;

a fourth transistor which is turned on or off depending on the first scan signal, wherein either a source or a drain of the fourth transistor is connected to the first scan line;

a fifth transistor which is turned on or off depending on a first signal and a second signal applied to a gate;

a pixel electrode; and a light-emitting element which emits light by a driving current which flows between the pixel electrode and a counter electrode, wherein the first signal supplied through the first transistor and the fourth transistor from the first scan line is a signal which cuts an electrical connection between the current supply line and the pixel electrode through the fifth transistor; and wherein the second signal supplied through the second transistor from a data line is a signal which makes the current supply line and the pixel electrode electrically connected to each other through the fifth transistor.

5. The semiconductor device according to claim 4, wherein a holding capacitor is provided between the gate of the fifth transistor and the current supply line.

6. The semiconductor device according to claim 4, wherein the first transistor, the second transistor, the third transistor, and the fourth transistor are N-channel transistors and the fifth transistor is a P-channel transistor.

7. The semiconductor device according to any one of claims 1 and 4, wherein an amplitude of the first scan signal is larger than an amplitude of the second scan signal.

8. A display device wherein the semiconductor device according to any one of claims 1 and 4 is provided for each pixel.

9. Electronic equipment wherein the display device according to claim 8 is provided.

10. A driving method of a semiconductor device comprising:

a first transistor to which a first scan signal is applied to a gate through a first scan line;

a second transistor to which a second scan signal is applied to a gate through a second scan line;

a third transistor which is turned on or off depending on a potential applied to a gate;

a pixel electrode; and a light-emitting element which emits light by a driving current which flows between the pixel electrode and a counter electrode, the driving method comprising:

a first period during which the first transistor is turned on by the first scan signal, and a first signal for cutting an electrical connection between a current supply line and the pixel electrode through the third transistor is inputted to the gate of the third transistor through the first transistor from the current supply line;

a second period during which the first transistor is turned off by the first scan signal, and the second transistor is turned off by the second scan signal; and a third period during which the second scan signal is inputted to the second transistor, wherein in the third period, in the case where a potential of a data line is smaller than a potential of the second scan signal, a second signal for electrically connecting between the current supply line and the pixel electrode through the third transistor is inputted to the gate of the third transistor through the second transistor from the data line.

11. The driving method of the semiconductor device according to claim 10, wherein the first signal is inputted through the first transistor from a wire having a potential different from that of the current supply line.

12. The driving method of the semiconductor device according to claim 10, wherein the first transistor and the second transistor are N-channel transistors and the third transistor is a P-channel transistor.

13. A driving method of a semiconductor device comprising:

a first transistor to which a first scan signal is applied to a gate through a first scan line;

a second transistor to which a second scan signal is applied to a gate through a second scan line;

a third transistor which is turned on or off depending on a potential of a current supply line;

a fourth transistor which is turned on or off depending on a signal applied to a gate;

a pixel electrode; and a light-emitting element which emits light by a driving current which flows between the pixel electrode and a counter electrode, the driving method comprising:

a first period during which the first transistor is turned on by the first scan signal, and a first signal for cutting an electrical connection between the current supply line and the pixel electrode through the fourth transistor is inputted to the gate of the fourth transistor through the first transistor and the third transistor from the first scan line;

a second period during which the first transistor is turned off by the first scan signal, and the second transistor is turned off by the second scan signal; and a third period during which the second scan signal is inputted to the second transistor, wherein in the third period, in the case where a potential of a data line is smaller than a potential of the second scan signal, a second signal for electrically connecting between the current supply line and the pixel electrode through the fourth transistor is inputted to the gate of the fourth transistor through the first transistor and the second transistor from the data line.

14. The driving method of the semiconductor device according to claim 13, wherein the first transistor and the second transistor are N-channel transistors and the third transistor and the fourth transistor are P-channel transistors.

15. A driving method of a semiconductor device comprising:

a first transistor to which a first scan signal is applied to a gate through a first scan line;

a second transistor to which a second scan signal is applied to a gate through a second scan line;

a third transistor which is turned on or off depending on a potential of a current supply line;

a fourth transistor which is turned on or off depending on the first scan signal;

a fifth transistor which is turned on or off depending on a signal applied to a gate;

a pixel electrode; and a light-emitting element which emits light by a driving current which flows between the pixel electrode and a counter electrode, the driving method comprising:

a first period during which the first transistor and the fourth transistor are turned on by the first scan signal, and a first signal for cutting an electrical connection between the current supply line and the pixel electrode through the fifth transistor is inputted to the gate of the fifth transistor through the first transistor and the fourth transistor from the first scan line;

a second period during which the first transistor is turned off by the first scan signal, and the second transistor is turned off by the second scan signal; and a third period during which the second scan signal is inputted to the second transistor, wherein in the third period, in the case where a potential of a data line is smaller than a potential of the second scan signal, a second signal for electrically connecting between the current supply line and the pixel electrode through the fifth transistor is inputted to the gate of the fifth transistor through the first transistor from the data line.

16. The driving method of the semiconductor device according to claim 15, wherein the first transistor, the second transistor, the third transistor, and the fourth transistor are N-channel transistors and the fifth transistor is a P-channel transistor.

17. The driving method of the semiconductor device according to any one of claims 10, 13 and 15, wherein an amplitude of the first scan signal is larger than an amplitude of the second scan signal.

* * * * *